United States Patent [19]

Whitaker et al.

[11] Patent Number: 4,622,687

[45] **Date of Patent: * Nov. 11, 1986**

[54] LIQUID COOLED ANODE X-RAY TUBES

[75] Inventors: Stephen Whitaker, Davis, Calif.; Arthur H. Iversen, 15315 Sobey Rd., Saratoga, Calif. 95070

[73] Assignee: Arthur H. Iversen, Saratoga, Calif.

[ * ] Notice: The portion of the term of this patent subsequent to Sep. 20, 2000 has been disclaimed.

[21] Appl. No.: 559,355

[22] PCT Filed: Feb. 16, 1983

[86] PCT No.: PCT/US83/00204

§ 371 Date: Oct. 14, 1983

§ 102(e) Date: Oct. 14, 1983

[87] PCT Pub. No.: WO83/02850

PCT Pub. Date: Aug. 18, 1983

Related U.S. Application Data

[63] Continuation-in-part of Ser. No. 348,785, Apr. 16, 1982, abandoned, and Ser. No. 250,275, Apr. 2, 1981, Pat. No. 4,405,876.

[51] Int. Cl.[4] ..... H01J 35/10; H01J 35/26

[52] U.S. Cl. ..... 378/130; 313/30; 378/141; 378/144

[58] Field of Search ..... 378/130, 141, 41, 144, 378/199, 200; 165/120, 86; 313/30

[56] References Cited

U.S. PATENT DOCUMENTS

| | | | |
|---|---|---|---|
| 2,90,543 | 8/1959 | Heuse | 378/130 |
| 1,972,414 | 9/1934 | Worden | 378/141 |
| 2,384,251 | 9/1945 | Hill | 165/86 |
| 2,493,606 | 1/1950 | Waterton | 378/200 |
| 2,633,327 | 3/1953 | McDowell | 165/86 |
| 2,942,126 | 6/1960 | Silbermann | 378/144 |
| 3,546,511 | 12/1970 | Shimula | 378/130 |
| 3,870,916 | 3/1975 | Küssel et al. | 378/130 |
| 4,130,773 | 12/1978 | Küssel et al. | 378/130 |
| 4,405,876 | 9/1983 | Iversen | 313/30 |

OTHER PUBLICATIONS

Philips Technical Review, vol. 19, 1957/50, No. 11, pp. 314–317.

A. Taylor, "High-Intensity Rotating Anode X-Ray Tubes", from Mallet et al., *Advances in X-Ray Analysis*, vol. 9, Plenum Press, N.Y., pp. 194–201.

Queisser, "X-Ray Optics: Applications to Solids", Springer-Verlag, N.Y., 1977, Ch. 2, pp. 9–33.

*Primary Examiner*—Craig E. Church
*Assistant Examiner*—Charles F. Wieland
*Attorney, Agent, or Firm*—Foley & Lardner

[57] ABSTRACT

Rotating anode x-ray generating apparatus including a mechanism which utilizes the rotational motion of the anode (20) to increase the effective rate of coolant with respect to the anode heat exchange surface (43).

50 Claims, 20 Drawing Figures

LIQUID COOLED ANODE X-RAY TUBES

CROSS-REFERENCE TO RELATED APPLICATION

This is a continuation-in-part of application Ser. No. 250,275 filed Apr. 2, 1981, by A. Iversen, one of the present inventors, now U.S. Pat. No. 4,405,876, and of Ser. No. 348,785 filed Apr. 16, 1982 by the present inventors, now abandoned.

TECHNICAL FIELD

The present invention is directed to liquid cooled anode x-ray tubes, and in particular, x-ray tubes having a continuously cooled anode whereby high average power is achieved while still maintaining the high peak powers characteristic of rotating anodes.

BACKGROUND OF THE INVENTION

The need for continuous duty, high power rotating anode x-ray tubes exists in medical radiography, i.e., fluoroscopy and computerized tomography (CT), and in industrial applications such as x-ray diffraction topography and non-destructive testing.

A number of schemes have been proposed in the past to achieve continuous power output at high peak power with a rotating anode x-ray tube. These include direct liquid cooling of the anode, liquid to vapor phase cooling of the anode, as well as other techniques.

Examples of rotating anode x-ray tubes using other than liquid cooling are described in U.S. Pat. No. 4,165,472 issued Aug. 21, 1979 to Wittry (liquid to vapor phase cooling in a sealed anode chamber), U.S. Pat. Nos. 3,959,865 issued to Konceszński on May 25, 1976, 3,719,847 issued to Webster on Mar. 6, 1973, 4,146,815 issued to Childenc on Mar. 6, 1973 (melting or vaporization of inserts in solid anode), and 3,736,175 issued to Blomgen May 22, 1973 (heat pipe to external heat sink).

Such rotating anode x-ray tubes have proven to be less efficient than direct liquid cooled tubes, and sometimes have a tendency to burst or explode when overheated, rendering such tubes unsafe.

Liquid cooled rotating anode x-ray tubes are, in general, well known. In such x-ray tubes, a hollow anode is disposed so that a rotating portion thereof is irradiated by an energy beam (e.g. electron beam). The irradiated portion of the anode is generally referred to as the electron beam track. Substantially all of the heat generated by irradiation by the energy beam is transmitted to a heat exchange surface, typically the interior wall of the hollow anode underlying the electron beam track and adjacent areas. In other words, the heat exchange surface is generally an area of the interior surface of the anode larger than the electron beam track, centered on and underlying the electron beam track. A flow of liquid coolant is passed into contact with the heat exchange surface to remove the heat therefrom, and thus cool the anode.

The basic cooling mechanism in liquid cooled anodes for use in x-ray tubes is nucleate boiling (or other vapor or gas mechanism). In nucleate boiling, bubbles of vaporized fluid are generated on the anode heat exchange surface. The vapor bubbles break away and are replaced by fresh bubbles, much like a pot of boiling water, thus providing efficient cooling by the removal of heat from the exchange surface to vaporize the liquids.

However, under certain circumstances, the power handling capacity of the system is limited by transformation of the nucleate boiling mechanism into what is known as a destructive film boiling phenomenon (or other vapor or gas blanket). The heated surface becomes surrounded by an insulating vapor blanket, thus causing significantly reduced heat transfer. The primary heat removal mechanism therefore becomes radiation and convection through the vapor.

The heat flux at the transition from nucleate to film boiling is called the critical heat flux. Should this value be exceeded in electrically heated structures such as a liquid cooled x-ray tube anode, the insulating film blanket would cause a rapid rise in temperature, typically resulting in burn out (i.e., melt down) of the structure. In general, burn out occurs very quickly, and the protective means required are extremely elaborate and expensive. Thus adequate protection has not heretofore been practical.

Formation of the boiling film occurs when expanding bubbles are generated faster than they can be carried away. The expanding nucleate bubbles interact and combine ultimately to form an insulating blanket of vapor. Thus, the transition is made from nucleate boiling to film boiling. It is therefore the bubble interaction which controls the heat transfer process.

To provide for efficient heat removal from the liquid cooled inner surface of the anode, i.e., at the anode heat exchange surface, a high relative velocity between the anode heat exchange surface and the liquid approximately 50 feet per second or greater, is required. In the past, high pressure pumps have been used to achieve the desired high liquid flow rates. However, use of high pressure pumps result in shortened rotational fluid seal life and attendant anode design limitations as will be hereinafter more fully discussed.

Examples of prior art liquid cooled rotating anode x-ray tubes are described in: Philips Technical Review, Vol. 19, 1957/58, No. 11, pp. 314–317, U.S. Pat. Nos. 4,130,773 issued to Kussel et al on Dec. 19, 1978, and 4,238,706 issued to Yashibara et al on Dec. 9, 1980 and A. Taylor, "High-Intensity Rotating Anode X-Ray Tubes", from Mallet et al, *Advances in X-Ray Analysis*, Vol. 9, Plenum Press N.Y. pp. 194–201. (describing the "Taylor device"). The rotating anode of the Philips device constitutes a hollow cylinder with three radially running tubes through which water flows to a cavity located along the inner surface of the peripheral wall or anode strip of the hollow body. In this device, the water flows back into the hollow drive shaft through three other tubes running radially in the rotary anode. However, various disadvantages have been attributed to the Philips device. For example, it is reported that only relatively low speeds of rotation can be obtained with the Philips rotary device because the maximum thickness of the peripheral wall provided as the anode target member allowable for proper cooling is not sufficient to withstand the pressures in the cooling medium that arise due to centrifugal force at higher speeds of revolution. Only relatively small surface density of illumination (brightness) can be obtained with this known rotary anode, since the intensity of illumination, i.e., radiation per unit of surface, generated by a device depends upon the rate of anode revolution.

The Kussel et al patent describes a liquid cooled rotating anode which purports to resolve the shortcomings of the Philips device. The portion of the rotary anode cylindrical peripheral wall, whereupon the electron beam strikes, is cooled with water supplied and removed, respectively, through coaxial ducts distributed by radial ducts in one end face of the rotary to a ring duct and gathered from a ring duct at the other end face through another set of radial ducts leading back to the shaft. Between the two ring ducts, the cooling medium flows through helical cooling ducts running parallel to each other and at an angle of about 15° to the edge boundaries of the cylindrical operating surface. These ducts are formed on the outside by the anode peripheral wall material itself and on the inside by a stainless steel insert with grooves machined thereon.

However, in order to obtain efficient heat transfer, relatively high coolant velocities are required with Kussel et al device. To achieve high coolant velocities, high pump pressures are needed. Unfortunately, the seals necessary to join stationary to rotating fluid conduits generally have short lives when subjected to such high coolant pressures and high speed anode rotation.

A more basic limitation of the Kussel et al device arises from the use of the grooved stainless steel insert to form the coolant ducts. The outermost rims of the groove walls are brazed to the anode peripheral wall. As described, the cooling ducts traverse one face of the anode to the other at a pitch angle of 15°. The brazed duct wall peripheries thus also transverse one face of the anode to the other at the prescribed 15° angle. Therefore, the electron beam alternately travels over coolant duct and duct wall as the anode rotates. When the electron beam is above the coolant, heat transfer is efficient, whereas when the beam is above the duct wall, the anode simulates more closely a solid metal structure, i.e., a conventional solid rotating anode. This creates a hot spot and severely limits the power handling capability because of the long heat path to the coolant. The braze alloy, used to braze the anode to the insert melts well below the metals used in the anode, and this further limits the power densities that can be handled. The duct walls, brazed to the periphery of the anode, which provide the necessary strength to the anode shell to prevent its distortion due to centrifugal force of the coolant, become a liability in that they become a limiting factor in power handling capability.

In the Taylor device, described in *Advances in X-Ray Analysis,* supra, liquid coolant flows in a direction transverse to anode rotation and interacts with the the anode in a manner known as "linear coolant flow". However, although there is a high relative velocity between the anode and coolant, the interaction is relatively inefficient and is reported by Taylor to provide only relatively low power (7½ kw). This stands in sharp contrast to the 100 kw attributed to the Kussel design. However, the Taylor design is not subject to performance-limiting centrifugal forces as the Philips device is, and permits the use of low pressure pumps and components.

Further, description of prior art liquid cooled rotating anode x-ray tubes is found in the following articles: G. Fournier, J. Mathieu: J. Phys. 8, 177 (1973), R. E. Clay: Proc. Phys. Soc. (London) 46,703 (1934), R. E. Clay, A. Miller: J. Instru. Elect. Engs, 84,261 (1939), W. T. Astbury, R. D. Preston: Nature 24,460 (1934), Z. Nishiyama: J. Japan Met. A. Soc. 15,42 (1940), V. Linnitzki, V. Gorski: Sov. Phys-Tech. Phys. 3,220 (1936), R. R. Wilson: Rev. Sci. Instr. 12,91 (1941), S. Miyake, S. Hoshino: X-sen 8,45 (1954), (Japanese) Y. Yoneda, K. Kohra, T. Futagami, M. Koga: Kyushu Univ. Engs. Dept. Rep. 27,87 (1954), S. Kiyono, M. Kanayuama, T. Konno, N. Nagashita: Technol. Rep., Tohoku Univ. XXVII, 103 (1936), A. Taylor: J. Sci. Instr. 26,225 (1949), Rev. Sci. Instr., 27,757 (1956), D. A. Davies: Rev. Sci. Instr. 30,488 (1959), P. Gay, P. B. Hirsh, J. S. Thorp, J. N. Keller: Proc. Phys. Soc. (London) B64,374 (1951), A. Muller: Proc. Roy. Soc. 117,31 (1927), W. T. Astbury: Brit. J. Rad. 22,360 (1949), E. A. Owen: J. Sci. Instr. 30,393 (1953), K. J. Queisser: X-ray Optics, Applications to Solids Verlag-Springer, NY (1977), Chap. 2, Longley: Rev. Sci. Instr. 46,1 (1975), Mayden: Conference on Microlithography, Paris, June 21-24, 1977, pp. 196-99, MacArthur: Electronics Eng. 17,1 (1944-5), A. E. DeBarr, Brit. J. Appli. Phys. 1,305 (1950).

In general, it is known that stable flow patterns in the coolant of a liquid cooled system inhibit the removal of nucleate bubbles and result in a substantial reduction of the cooling efficiency of the system. For a detailed discussion of flow patterns see Greenspan, *The Theory of Rotating Fluids,* Cambridge Press, 1969. It has now been discovered that the coolant flow fields generated with the anode of conventional liquid cooled rotating anode devices have such inherently stable rotational motion which results in a substantial reduction of the power rating of the tube.

Such stable flow patterns are established by the fact that the liquid adjacent the rotating anode surface has a high velocity induced in it, whereas the liquid adjacent the stationary inner cylinder i.e. the septum has a low velocity. In turbulent flow, the velocity gradients from both the stationary surface (septum) and rotating surface (anode) are high. Since the liquid at the largest radius (at the anode surface) has the highest velocity, it therefore has the highest centrifugal force associated with it. This forces the liquid outward against the anode surface. Thus, the water cannot be inwardly displaced and liquid circulating patterns are inhibited. The large velocity gradients, i.e. centrifugal force gradient at the anode surface further aggravates the problem. Thus, the liquid flow pattern is literally in the "grip" of the rotating anode and a stable flow pattern is established that must be broken up or prevented to enable liquid to circulate at the anode surface to facilitate removal of nucleate bubbles which will increase heat transfer. The viscous or laminar sublayer—a thin layer of laminar flow adjacent to the wall of the conduit and always present in turbulent flow—provides a mechanism to further cause the nucleate bubbles to adhere more readily to the anode surface.

The rate of nucleate bubble removal may be increased by breaking up this viscous or laminar sublayer. As described in co-pending U.S. Application Ser. No. 250,275, filed on Apr. 2, 1981 by Arthur Iversen, such viscous sublayer can be broken up by roughening the anode coolant surface. When the height of the roughening projections ranges from 0.3 times the thickness of the viscous sublayer to the sum of the thickness of the viscous sublayer and a transition zone adjacent the viscous sublayer, the sublayer is broken up. Breaking up the viscous sublayer enables the turbulent fluid to reach the base of the nucleate bubble, where it is attached to the anode, thereby providing the energy needed to break it loose. The geometry of nucleate bubbles is a function of the surface roughness geometry; small fissures tend to generate small nucleate bubbles, whereas large fissures tend to generate larger ones. Therefore, nucleate bubble size and generation can be optimized by providing a surface of calculated and preferably uniform roughness and geometry. A regular roughness geometry can be obtained by suitable conventional techniques such as, for example, chemically by means of chemical milling; electronically, by the use of lasers or electron beams; or mechanically, by broaching, hobbing, machining, milling, stamping, engraving, etc.

Another method of obtaining a surface with crevices for forming nucleate bubbles is the use of a thin porous metal layer adherent to the anode at the anode heat exchange surface. This porous metal layer may be considered to provide a contoured surface as defined above. Relatively uniform pore size can be obtained by fabricating the porous structure from metal powders with a narrow range of particle sizes. Methods, such as described in U.S. Pat. No. 3,433,632, issued to Ebbertotal on Mar. 18, 1969, are well suited to providing the desired porous metal structure.

SUMMARY OF THE INVENTION

The present invention provides a long life continuous duty liquid cooled rotating anode x-ray tube that possesses high power capabilities while using low pressure pumps and components. Heat flux (rate of heat removal), and critical heat flux (burn out), are increased as compared to prior art liquid cooled rotating anode x-ray tubes. Simultaneous and continuous liquid cooling of the entire heat exchange surface of the hollow rotating anode is provided thereby avoiding any power limiting hot spots. High relative velocity of the anode to coolant liquid with low input liquid velocities are provided, while using long lived rotational liquid seals, and low pressure liquid pumps and components.

Further, undesirable liquid flow characteristics within the anode such as cavitation, eddies and vortex shedding which reduce the power rating of the tube, increase the required pump pressure, and cause vibration, are minimized. In addition, inherently stable liquid flow patterns associated with externally rotating surfaces, i.e. anodes, are substantially eliminated thereby increasing the power handling capabilities of the anode.

The foregoing is accomplished in accordance with the present invention by utilizing the rotational motion of the anode, either directly or indirectly, to increase the liquid flow rate. For example, axial flow pump blades are mounted on the inside diameter, i.e. in the liquid conduit, or the hollow rotating shaft, and/or centrifugal pump vanes are mounted on the inside face of the hollow rotating anode to increase liquid flow rate by direct use of the rotational motion of the anode. Similarly, gear pump elements driven by the rotational motion of the anode, can be incorporated in the liquid conduit between the inside face of the rotating anode and the stationary septum. The gear pump elements would be attached, as required, to either the rotating anode or stationary septum to increase flow rate by indirect use of anode rotation.

The design of the above described various means for increasing the liquid flow rate enables localized high pressure and high liquid velocities as well as high flow rates to be achieved in the proximity of the anode heat exchange surface, thus enabling efficient heat transfer, while the rest of the liquid cooling loop remains at low pressure, thereby eliminating the need for external high pressure rotating liquid seals, pumps and components with their attendant higher costs and shorter life.

In addition, the flow of liquid is directed to traverse the path of anode rotation along a plurality of independent channels to interact with the anode heat exchange surface in a manner to obtain optimum heat exchange, while simultaneously avoiding or minimizing undesirable liquid flow fields or characteristics such as cavitation, eddies, vortex shedding or inherently stable rotational motion. For example, axial flow pump vanes mounted on the stationary septum contained within the hollow anode and/or radial conduits are constructed substantially in a radial direction through a radial thickness of the stationary septum.

The mechanisms for increasing the liquid flow rate combined with the liquid directing means serve to confine a substantial portion of the associated high pressures to the vicinity of the anode heat exchange region thereby enabling the remainder of the liquid loop, including the liquid rotating seals, to operate at low pressure with consequent lower cost, ease of maintenance and longer life. Moreover, each of the preferred mechanisms for increasing liquid flow rate and for directing the liquid flow substantially eliminates the inherently stabilizing rotational motion of the liquid found in conventional liquid cooled rotating anode x-ray tubes. The axial flow pump vanes, which come into close proximity to the interior anode surface serve to break up the stable liquid flow patterns which cause reduced heat flux and lower critical heat flux i.e. burn out. Also, the axial flow pump vanes serve to break up the liquid flow across the anode surface into a large number of essentially independent channels. This forces the liquid to move in a direction different from that of the anode. This breakup of the liquid flow across the anode into a large number of segregated channels further interrupts the establishment of the inherently stable flow patterns. Similarly, use of a number of conduits, which may be circular, substantially radially constructed through a radial thickness of the septum to direct the liquid prevents the establishment of stable flow patterns by virtue of the multitude of high velocity jets of liquid emanating from the periphery of the septum and simultaneously striking the entire anode heat exchange surface.

State of the art liquid cooled rotating anode x-ray tubes have heat transfer capabilities in the 600 to 1200 watts/cm$^2$ range. It has been calculated that the present invention will enable heat transfer rates of 12,000 watts/cm$^2$ to be achieved for systems which are liquid heat transfer limited. Combining a pump and the rotating anode into a single unit enables high liquid flow rates and corresponding pressures to be obtained in the proximity of the anode heat exchange surface thus enabling more efficient heat exchange to be effected.

DESCRIPTION OF THE DRAWINGS

Preferred exemplary embodiments of the present invention will hereinafter be described in conjunction with the appended drawings wherein like designations denote like elements, and;

Referring now to FIG. 1, the basic structure of a liquid cooled rotating anode x-ray tube will be described. A hollow anode 20 attaches to a hollow rotating shaft 21. A rotational fluid seal 22 is mounted at the end of hollow shaft 21. A stationary cupped cylindrical attachment 23 with entrance duct 24 is mounted to rotational fluid seal 22. A stationary tube 25 disposed concentrically with, and extends through, stationary hollow cupped cylindrical attachment 23. A hermetic seal is provided between attachment 23 and stationary tube 25. Stationary tube 25 extends longitudinally, and concentrically, within hollow rotatable shaft 21 into the hollow rotatable anode 20. A stationary septum 26 is mounted on hollow stationary tube 25, and disposed within hollow anode 20. Hollow anode 20 is rotatably coupled to stationary septum 26 by a rotational bearing 27 and a fin shaped radial support and centering structure 28 attached to the inner, stationary segment of bearing 27.

Figure 1:
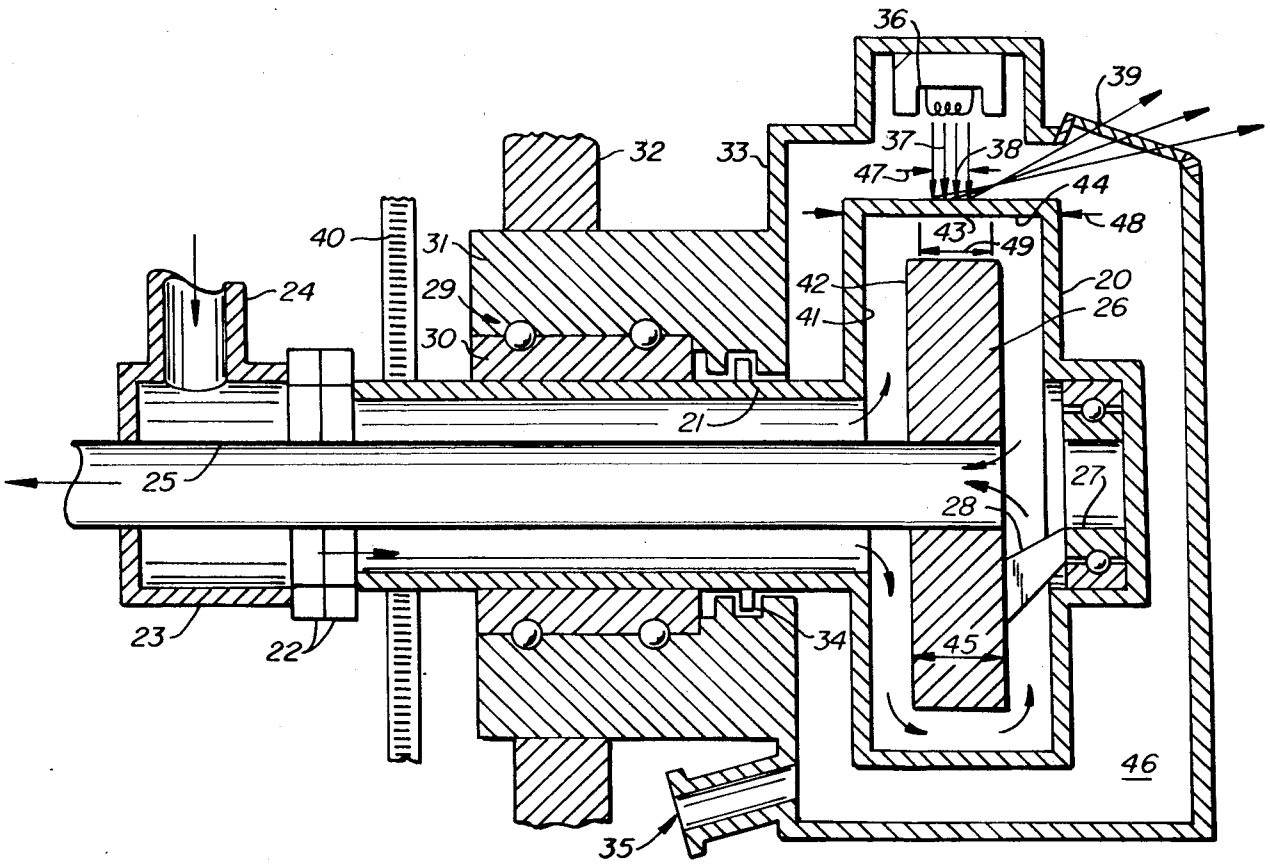
FIG. 1. PRIOR ART
FIG. 1 is a complete cross section of a rotating anode x-ray tube.

A rotatable bearing member 29 including an inner rotating segment 30 and outer stationary segment 31 is utilized to rotatably couple rotatable shaft 21 to a mounting member 32 and to a vacuum envelope 33. Inner rotating segment 30 of rotatable bearing member 29 is fastened to the outside diameter of hollow rotatable shaft 21. Outer stationary segment 31 of rotatable bearing member 29 is fastened to mounting member 32 and vacuum envelope 33. Suitable rotatable high vacuum sealing means 34 such as ferrofluidic seal, is incorporated in bearing 29 to vacuum seal stationary member 31 to rotatable shaft 21 to facilitate the provision of a vacuum within vacuum envelope 33, surrounding anode 20.

An electron gun 36 is mounted within vacuum envelope 33. Electron gun 36 provides an electron beam 37 focused upon electron beam track 38 on the exterior periphery of anode 20. Illumination of anode 20 by beam 37 causes generation of x-rays which exit through a vacuum tight x-ray transparent window 39 in vacuum envelope 33.

A pulley 40, or other means, is connected to a suitable motor by a belt (not shown) to provide rotational drive to shaft 21, and thus, anode 20. A port 35 is provided in envelope 33 for attachment to means, not shown, to obtain or maintain the necessary vacuum within the evacuated space 46. The vacuum may be generated by, for example, barium, titanium or zirconium getters or VAC-Ion, titanium sublimation, cryogenic, turbomolecular, diffusion or other vacuum pumps.

The basic structure of FIG. 1, having been described above, functions as follows. Cooled fluid from an external heat exchanger and pump assembly (not shown) is pumped into the x-ray tube through duct 24. The coolant then travels toward the anode 20 between the outer diameter of stationary inner tube 25, and the inner diameter of rotatable hollow shaft 21. The coolant then passes along inside input face 41 of anode 20, and outside of input face 42 of septum 26, until it reaches the anode heat exchange surface 43.

Septum 26 serves to direct the entire coolant flow into close proximity to the anode heat exchange surface by providing a narrow channel between the septum 26 and anode heat exchange surface 43. The width of the septum 45 is typically greater than the width of the electron beam track 47 and is generally centered with the electron beam track. The spacing between the septum and the anode heat exchange surface is designed to maintain optimum flow and heat exchange conditions. The geometry is always such that the entire heat exchange surface of the anode is simultaneously and continuously exposed to coolant flow. In this manner, the entire heat exchange surface is continuously cooled and hot spots cannot develop due to interrupted coolant availability. Thus, optimum heat transfer is obtained and maintained.

Having passed over the anode heat exchange surface 43 to point 44, the heated coolant now passes the outboard faces of the anode inside surface and septum, past support fins 28 and out through the inside of stationary tube 25. From there, the coolant proceeds to the external heat exchanger pump (not shown) and back to the x-ray tube.

It is desirable that the temperature rise at the rotatable vacuum seal 34 be minimized. The ferro-fluidic vacuum sealing fluids have viscosity and vapor pressure characteristics that are very sensitive to temperature with the typical maximum operating temperature being 50° C. Accordingly, the cooled liquid is passed between the outer diameter of inner tube 25 and the inner diameter of rotatable shaft 21. This passes cooled input liquid against the vacuum seal, to maintain minimum temperatures and thus optimize operating conditions. Reversing the direction of flow would pass heated liquid next to the vacuum seal, raising the temperature of the seal. The increased seal temperature tends to cause degradation of operating rpm and degrades the vacuum due to the increased vapor pressure of heated ferrofluids. However, with a suitable cooling and insulating scheme for the vacuum seal, the coolant flow direction could be reversed which has the advantages with respect to minimizing induced rotational velocity in the liquid flow.

As previously noted, the critical heat flux, i.e. burn out, and rate of heat removal are determined by the formation of nucleate bubbles on the anode heat exchange surface 43 and removal of such nucleate bubbles on the heat exchange surface 43 by interaction with the coolant liquid. As also previously discussed, the laminar nature of the liquid flow, and stable flow patterns caused by the rotation of the anode, tend to retard removal of the bubbles, thus decreasing the heat removal capacity of the system.

As described in the aforementioned copending application Ser. No. 250,275 by Iversen, the rate of removal can be increased by creating a pressure gradient in the coolant fluid perpendicular to the anode surface, and/or by breaking up the viscous sublayer of the coolant fluid nearest the heat exchange surface.

The rate of removal can also be increased by providing a high shear velocity between the anode heat exchange surface and the liquid. As previously noted, in the past this has entailed use of coolant liquid under high pressure. This has required use of relatively short-lived high pressure fluid seals. Moreover, the inherently stable flow pattern caused by the anode rotation has tended to limit the power rating of the prior art tubes.

Figure 2:
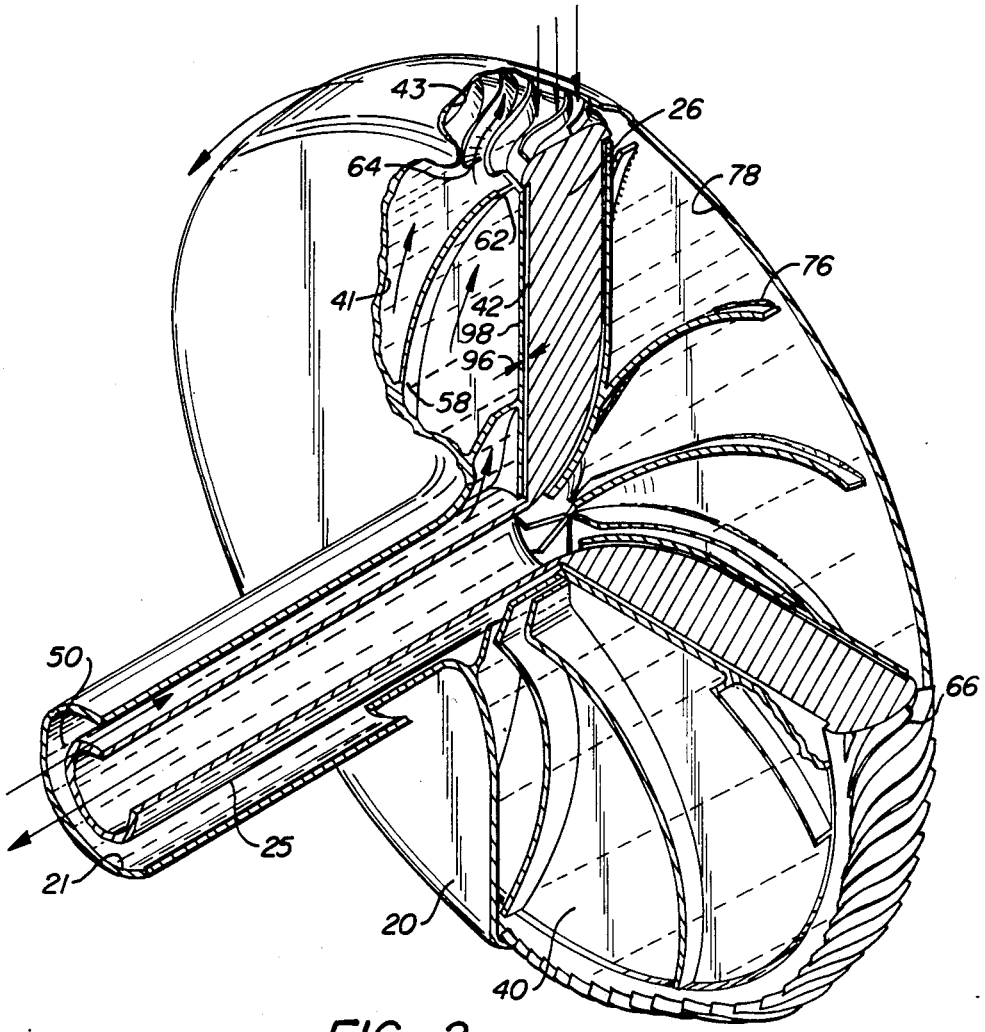
FIG. 2 is a perspective view of the anode-septum assembly illustrating centrifugal pump vanes mounted on the anode to increase the liquid flow rate, axial flow pump vanes mounted on the septum to direct the liquid flow and turbine vanes mounted on the anode discharge face for liquid discharge.
Figure 2A:
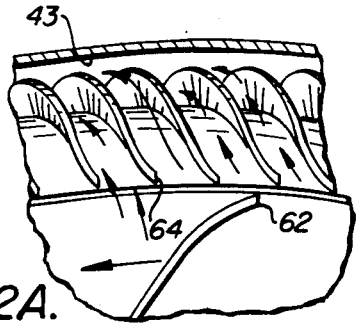
Figure 3:
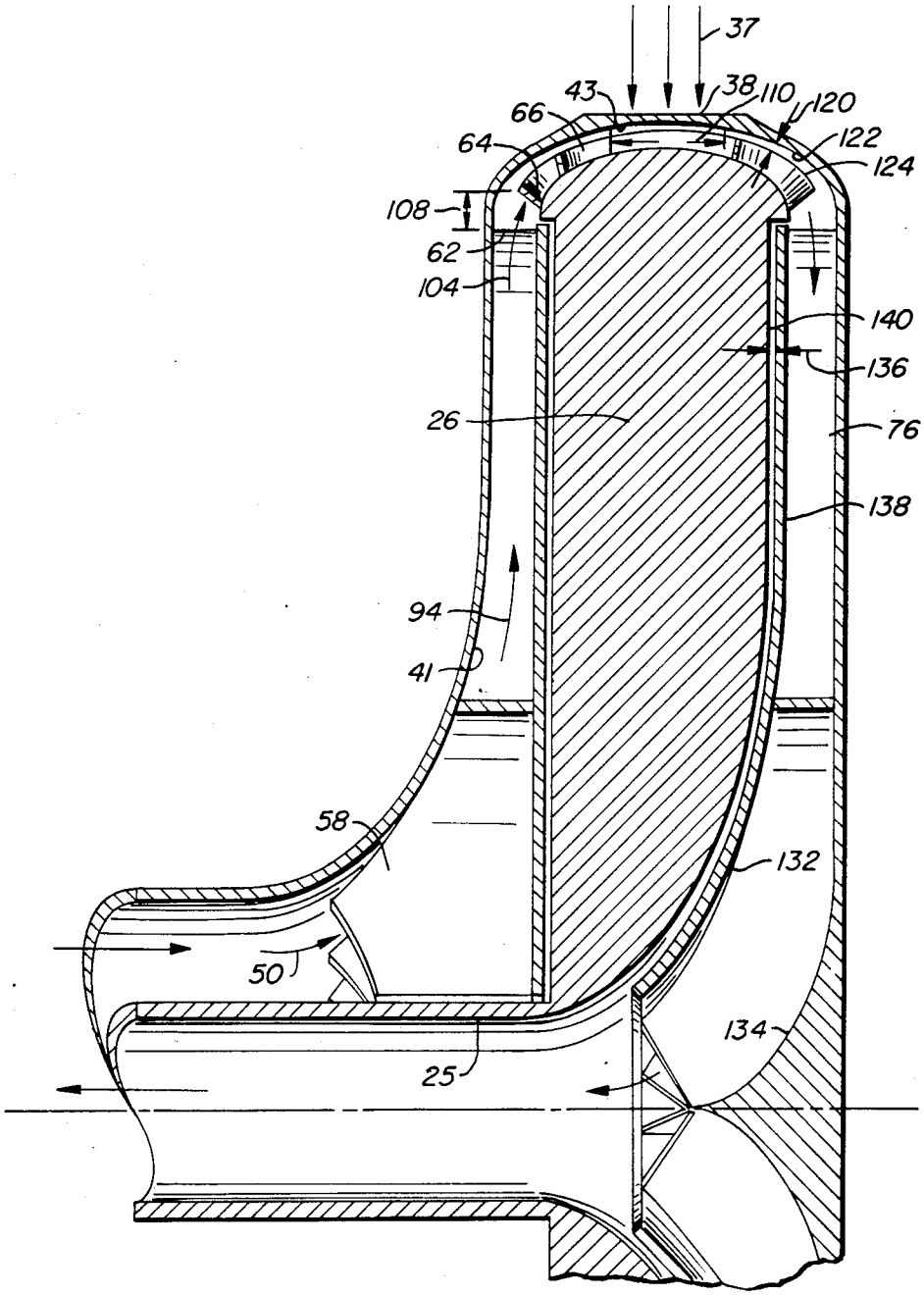
FIG. 3 is a partial side cross-sectional view of the anode septum assembly showing centrifugal pump vanes, axial flow pump vanes and turbine vanes.

Referring now to FIGS. 2, 3, and 4, a first preferred embodiment of the present invention will be described wherein the liquid flow rate is increased by the provision of a centrifugal pump impeller mounted on the input face of the rotating anode, and axial flow pump vanes are mounted on the stationary septum to prevent inherently stable flow patterns due to the rotating motion of the anode, provides a high shear velocity between the liquid and the anode heat exchange surface.

Reference is now made to FIG. 2, a cutaway perspective of the anode-septum assembly of the first preferred exemplary embodiment for a general description of the embodiment. A plurality of centrifugal pump vanes 58 are mounted on the interior input surface 41 of anode 20. Similarly, a plurality of turbine vanes 76 are fixed to the interior outboard face 78 of the rotating anode. The rotation of the anode causes rotation of the attached centrifugal pump and exhaust turbine vanes. In addition, a multiplicity of generally S-shaped axial flow pump vanes 66 are mounted on the surface of stationary septum 26 facing the anode heat exchange surface 43.

In operation cooled input liquid 50 flows in toward anode 20 between the inside diameter of hollow rotary shaft 21 and the outside diameter of inner stationary tube 25. The cooled input liquid then is engaged by centrifugal pump vane 58, which directly utilizes the rotation of the anode to impart radial and circumferential velocity to the coolant. As the cooled input liquid reaches the outermost portion 62 of the centrifugal pump vane it is engaged by the leading edge 64 of the axial flow pump vanes 66. The axial flow pump vanes 66, generally of a "S" shape, extend across the peripheral surface of septum 26. Axial pump vanes 66 redirect the liquid into a plurality of independent channels disposed transverse to the direction of rotation (generally parallel to the axis of rotation); to prevent formation of stable flow patterns by the rotational motion of the anode. After passing the anode heat exchange surface 43, the liquid is engaged by exhaust turbine vane 76 which is attached to output anode face 78. The exhaust turbine vane 76 serves to enable the liquid to smoothly make the transition from the axial flow pump vanes 66 to the exhaust tube 25 with a minimum of undesirable flow characteristics such as cavitation, eddies and vortex shedding. The curvature of the septum 26 and vanes 66 serve to further assist in the smooth transit of the liquid flow. After passing through stationary exhaust tube 25, the exhaust liquid is carried to an external heat exchanger and is then again pumped back to the x-ray tube with a low pressure pump.

A more specific description of the first embodiment will now be provided in conjunction with FIGS. 2, 3, and 4. Centrifugal pump vanes 58 are all suitably connected to a common shroud 98 along the vane peripheries proximate to septum 26. The spacing 96 between the centrifugal pump vane shroud 98 (or vane periphery) and the septum surface 42 is set at a small value to provide a bearing surface for the rotating anode thereby to avoid or minimize vibration. This desired spacing 96 is a function of liquid viscosity and the surface speed of the rotating shroud 98 and stationary surfaces 42. Entering liquid 50 is engaged, as best shown in FIG. 3, by centrifugal pump vane 58 mounted on anode face 41. The liquid engaged by vanes 58, 94 generally indicated by arrow is accelerated by the anode in the manner of a conventional centrifugal pump.

Upon leaving the end 62 of centrifugal pump vane 58, the liquid (designated by arrow 104) engages the axial flow pump vane 66. The spacing 108 between centrifugal pump vane and edge 64 of axial flow pump vane 66 is designed so as to permit optimum liquid coupling. The liquid flows through the axial flow pump vanes 66 past the anode heat exchange surface 43 of width 110, which may have calculated surface roughness thereon as previously described. The anode heat exchange surface 43 is shown as suitably curved, said curve being one of an infinite number of curves lying in the plane containing the axis of rotation of the anode, said plane being rotated about said axis of rotation. Thus, the liquid flowing over the curved anode heat exchange surface generates a pressure gradient having a component perpendicular to the anode heat exchange surface, thereby improving heat transfer and minimizing cavitation. As also shown, the peripheral surfaces of septum 26 and axial flow pump vanes 66 are correspondingly curved thereby minimizing undesirable flow characteristics and enabling the proper anode-axial flow pump vane spacing to be maintained. The anode heat exchange surface 43 is shown as suitably curved, said curve being one of an infinite number of curves lying in the plane containing the axis of rotation of the anode and rotated about said axis. The body force generated by the liquid flowing over the anode heat exchange surface has a component perpendicular to the anode heat exchange surface. As also shown, the peripheral surfaces of septum 26 and axial flow pump vanes 66 are correspondingly curved thereby minimizing undesirable flow characteristics such as cavitation and enabling the proper anode-axial flow pump vane spacing 120 to be maintained. The electron beam track 38 on the anode surface is illuminated by electron beam 37. The spacing 120 between the inner wetted anode surface 122 and the periphery of the axial flow pump vanes 124 is small enough to break up the inherently stable rotational flow that is frequently present in conventional tubes. In addition, the spacing 120 is further optimized so as to provide additional support for anode vibration suppression as will be explained.

Leaving the axial flow pump vane, the liquid is engaged by the exhaust turbine vane 76 whence it is directed toward exhaust tube 25. As best seen in FIG. 3 each of the turbine vanes 76 suitably include inwardly curved transition portions 132, and 134 approaching exhaust tube 25 to inhibit undesirable flow characteristics such as cavitation, eddies and vortex shedding. Turbine vanes 76 are also suitably coupled along the peripheries proximate to septum 26 by a shroud 138. Spacing 136 (or vane periphery) is designed to be small enough to serve as a bearing surface for the anode and thereby also minimize vibration as will be explained.

Figure 4A:
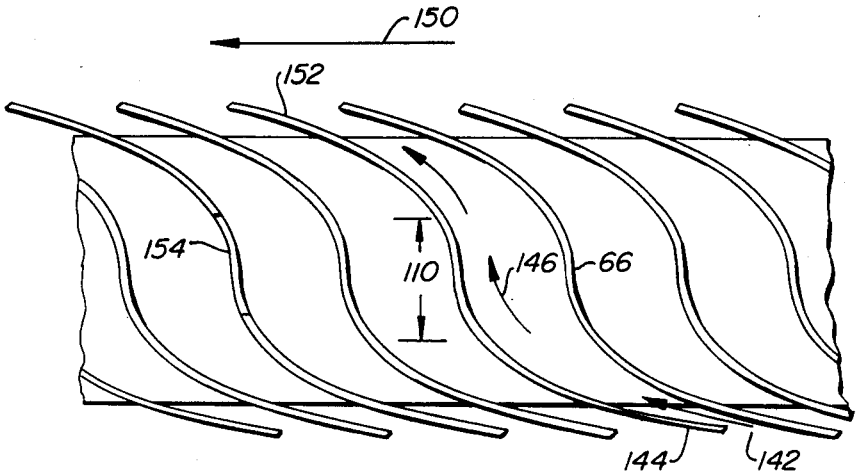
FIG. 4 is a partial vertical view of the septum showing the axial flow pump vanes mounted on the septum.
Figure 4B:
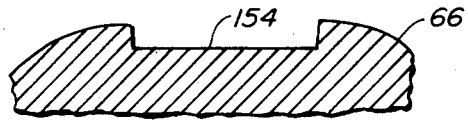

Axial flow pump vanes 66 direct the fluid along a plurality of independent channels disposed transverse to the direction of rotating (generally parallel to the axis of rotation). The plurality of independent channels prevents formation of stable flow patterns due to the rotational motion of the anode and optimized heat transfer. Referring now to FIGS. 4A and 4B, liquid flow, denoted by arrow, 142 from anode mounted centrifugal pump (not shown) enters the curved section 144 of the axial flow pump vane 66. The curved section 144 of axial flow pump vane 66 serves to provide a smooth change in direction for the liquid thereby eliminating or minimizing undesirable flow characteristics such as cavitation, eddies or vortex shedding. When the liquid flow passes under the anode heat exchange region 110, the flow 146 is approximately at right angles to the anode rotation 150. The interaction of the rotating anode heat exchange surface with the liquid as it flows between the axial flow pump vanes induces a swirl flow in the conduit defined by one face of the axial flow vane, the septum, the opposite axial flow vane face and the anode heat exchange surface; the rougher the anode heat exchange surface, the more energetic the swirl flow. Such swirl flow is, in effect, a helical motion of the coolant which generates pressure gradients normal to the anode heat exchange surface. For a description of swirl flows in general, reference is made to Gambill and Green, Chem. Eng. Prog. 54, 10, 1958. This inducted rotational motion that occurs in the above described conduits between axial flow pump vanes will further enhance the heat transfer rate by carrying hot liquid away from the anode heat exchange surface and supplying cool liquid to the anode heat exchange surface as the liquid flow traverses the path of anode rotation.

The high shear velocity between the anode and liquid combined with the high pressures generated by centrifugal pump vanes (i.e. over 200 psi), and the liquid changing direction provides high heat transfer. After passing the anode heat exchange region, the liquid is again redirected by a further curved portion 152 of axial flow pump vane prior to its smooth transition to the exhaust turbine vanes (not shown).

In some cases, the collapse of nucleate bubbles on metal surfaces can have an adverse affect on the metal. Therefore, in those geometries where this may be a concern, means to minimize this problem are shown in FIG. 4B. A slot 154 of predetermined width and depth is provided in the axial flow pump vanes. The slot width corresponds approximately in dimension and position to the width 110 of the anode heat exchange surface and the depth of the slot corresponds approximately to the diameter of the larger nucleate bubbles. Thus, those nucleate bubbles that have not passed into the coolant but instead remain on the anode and come up against the axial flow vane periphery, which is in close proximity to the anode heat exchange surface, can pass through the slot made in the axial flow vanes. Thus, the nucleate bubble is not "scraped off" by the axial flow pump vane with consequent collapse on the vane and possible resultant damage. Instead, the nucleate bubble can pass into the next conduit defined by the next pair of axial flow vanes where it can release into the coolant and thereby pose no potential for damage on the metal surface of the vane. The depth of the slot is, however, small enough to permit vanes 66 to significantly reduce any stable rotational patterns induced in the liquid by the rotation of the anode. In some cases, collapse of nucleate bubbles on metal surfaces can also be avoided by the contouring or calculated roughness of the anode heat exchange surface.

It should be appreciated from the foregoing that the anode-septum structure shown in FIGS. 2, 3, and 4 provides, in effect, a centrifuged pump on the liquid inlet side and a turbine on the discharge side to obtain high fluid pressure and flow in the vicinity of the anode heat exchange surface. The provision of axial flow pump vanes on the septum, between the input centrifugal pump and exhaust turbine, serves optimally to redirect the flow rates of the liquid so that it traverses the direction of anode rotation. The design of the various vanes i.e. the liquid accelerating and directing surfaces, the input centrifugal pump mounted on the input side of the anode, the axial flow pump vanes mounted on the septum and the turbine vanes on the discharge side of the anode, are shaped so as to provide for acceleration, change of direction and exhaust of the coolant liquid in such a manner as to avoid undesired flow characteristics such as cavitation, vortex shedding, eddies and inherently stable rotation such as commonly occur in conventional liquid cooled rotating anode x-ray tubes. Thus, flow of liquid throughout the x-ray tube is maintained in a smooth and continuous manner with minimum generation of undesired flow characteristics which can result in reduced power handling capabilities, increased pressure requirements and vibration.

The centrifugal pump impeller is built into the input face of the anode and serves to accelerate the coolant liquid up the face of the anode toward the anode heat exchange surface along the impeller vane to high velocity. The liquid then flows into the stationary axial flow pump vanes mounted on the septum, which redirect the flow of liquid such that it traverses the path of the anode rotation in the region of the anode heat exchange surface. The shape of the axial flow pump vanes, which are similar in design to conventional axial flow pump vanes, typically of an "S" shape, may be varied so as to obtain optimum performance. The smaller the radius of curvature in any given segment of the axial flow vane, the greater the local pressure that is generated in the liquid because of the greater rate of change in the direction of liquid flow. Generally, it is desired to obtain the greatest pressure in the anode heat exchange region to optimize heat transfer. Thus, excellent heat transfer is obtained by virtue of both the high relative velocity between anode and the liquid due to anode rotation, and the high velocity of the liquid as it traverses the path of anode rotation due to the action of the centrifugal pump. The relative velocity of anode to liquid is the resultant of the anode velocity vector and the liquid flow velocity vector. In general, the resulting relative velocity of anode to fluid will be substantially greater than either velocity alone thereby further improving heat transfer. To further enhance heat transfer, the anode heat exchange surface is prepared, in accordance with the teachings of the aforementioned copending application Ser. No. 250,275 by Iversen with a calculated surface roughness such that the length of the surface roughness elements is not less than 0.3 times the thickness of the viscous sublayer and not more than the sum of the thickness of the viscous sublayer and the transition zone.

After passing through the anode heat exchange region, the axial flow pump vanes again redirect the liquid flow such that a smooth transition is made into the exhaust turbine, the turbine impeller design being similar to that of conventional turbine pumps. The exhaust turbine serves to smoothly, and again without unwanted flow characteristics, direct the flow of the heated coolant radially down the face of the anode and into the exhaust tube contained concentrically within the hollow anode shaft for discharge into the external heat exchanger.

A further important consideration in the design of liquid cooled rotating anode x-ray tubes is the problem of vibration. In certain applications, such as x-ray lithography, vibration is highly undesirable because of the small dimensions and fine tolerances being sought, typically sub-micron. In rotating systems used for the movement of liquids, such as pumps, there are three sources of vibration. One source is mechanical imbalance and improper bearing design. This design area, mechanical in nature, is well understood and generally is not a problem. The second source of vibration is improper liquid flow in the system such as cavitation, vortex shedding and eddies. In general, improper liquid flow is caused by liquid flowing through improper conduit geometries such as around or into sharp corners. The third is improper pump element and housing design i.e. improper tolerance between close spaced stationary and moving parts.

Further aggravating the above is the structurally unsupported nature of the anode in many of the liquid cooled rotating anode x-ray tube designs. In the prior art structures, there is typically of necessity, a relatively large spacing between the anode and the septum since this serves as the liquid flow passage. In some designs, this passage height is minimized in the vicinity of the anode heat exchange surface so as to increase the velocity of liquid past the heat anode surface and thereby improve the heat transfer. However, the gap must always be large enough to permit adequate flow of liquid for cooling purposes. It is well known in pump design that a method for suppressing vibration is to provide very close spacing between moving and stationary parts, i.e. the pump impeller and the housing. The fluid present in these small gaps act as a cushioning means thereby suppressing vibration. The supporting characteristics, however, vary inversely as the cube of the spacing between the adjacent members. Close spacing also serves to substantially isolate one segment of the pump from another thus minimizing the flow of liquid from one segment to another. Current designs state or show no provision for this type of vibration suppression means.

By mounting axial flow pump vanes on the outside face of the septum, between the rotating anode and the septum, the dimensions provide a close fit between the anode face and the top of the vane. Thus, in addition to preventing rotational motion in the liquid from being induced by the anode rotation, the vanes also serve as a support to the anode and thereby reduce the vibration caused or amplified by the large gap i.e. the liquid flow passage, between the anode and the septum. The centrifugal pump and turbine similarly provide added structural support to reduce vibration and suppress induced rotational motion in the liquid flow caused by the rotation of the anode. Suppression of rotational flow has special importance on the discharge side of the anode where the liquid must travel radially inward toward the anode shaft for discharge inasmuch as the centrifugal force arising from the induced rotational motion of the liquid requires a corresponding increase in pump pressure to overcome it. Thus, pump pressure can be reduced with a corresponding increase in the life of the rotating liquid seals, and economy of pump, fittings, etc.

In accordance with another aspect of the present invention, the fluid flow path can be configured to maximize swirl flow in the anode heat exchange region. Heat transfer is enhanced by the centrifugal force generated by the swirling motion of the coolant as it traverses the anode heat exchange surface. A pressure gradient with a component perpendicular to the anode heat exchange surface is established that more rapidly breaks loose the nucleate bubbles thereby increasing both the heat flux and the critical heat flux i.e. burn out. The swirl flow is maximized by disposing converging elements at the input side of axial flow vanes traversing the top of the septum such that the radial thickness of the rotating liquid is reduced to approximately one-half of the effective diameter of a swirl flow conduit comprising the axial flow vane surface, the anode surface, the opposite axial flow vane surface and the septum surface. Then, the liquid is injected into the anode heat exchange region tangential to a surface of the conduit. The injection angle of the coolant into the swirl flow conduit is such that the tangent of the angle is the ratio of the width of the injected coolant stream to the effective circumference i.e. outer diameter of the swirl flow conduit. The axis of the swirl flow conduits will be at approximately 90° to the direction of anode rotation in the anode heat exchange region. Thus, between adjacent axial flow pump vanes there will be independent flows past the anode heat exchange surface. These swirl flows will be flowing in parallel and the number of conduits will be one less than the number of axial flow vanes mounted on the septum. The system efficiency is greatly enhanced by the short length of the swirl flow conduit i.e. low pressure drop and retention of swirl flow geometry, and high flow capacity resulting from the numerous parallel conduits.

Heat transfer is further enhanced because the preferred orientation of injection of the liquid into the axial flow vane conduit is such that the liquid is flowing substantially in the opposite direction of anode rotation at the anode surface, that is, the vector sum of the two velocities, i.e. liquid and anode, can approach the sum of the scalar values. the large surface of the converging element also serves to further improve anode support i.e. a substantial increase in the bearing surface thereby further inhibiting any vibration.

After passing the anode heat exchange region, the heated liquid flow leaves the axial flow pump vanes and enters the discharge face of the anode to travel down the face of the anode toward the exhaust tube that is concentric with the hollow anode shaft. Inasmuch as the liquid is flowing in a swirl pattern i.e. rotating as it passes between axial flow vanes and because the effective diameter of swirl (rotation) is small compared to the diameter of the anode, the angle i.e. direction of discharge of the swirl flow into the exhaust face of the anode may be selected. The preferred direction of discharge is approximately along a radius so that the liquid discharge is directed at the exhaust tube.

In lieu of the exhaust turbine previously described, vanes with peripheral surfaces in close proximity to the anode face, are mounted radially on the discharge face of the septum to minimize rotational velocity induced in the liquid by the rotating anode as the liquid travels toward the exhaust exit tube and to assist in the suppression of vibration. Such an anode-septum structure will hereinafter be more fully described in conjunction with FIGS. 5, 6, 7 and 8.

Figure 5:
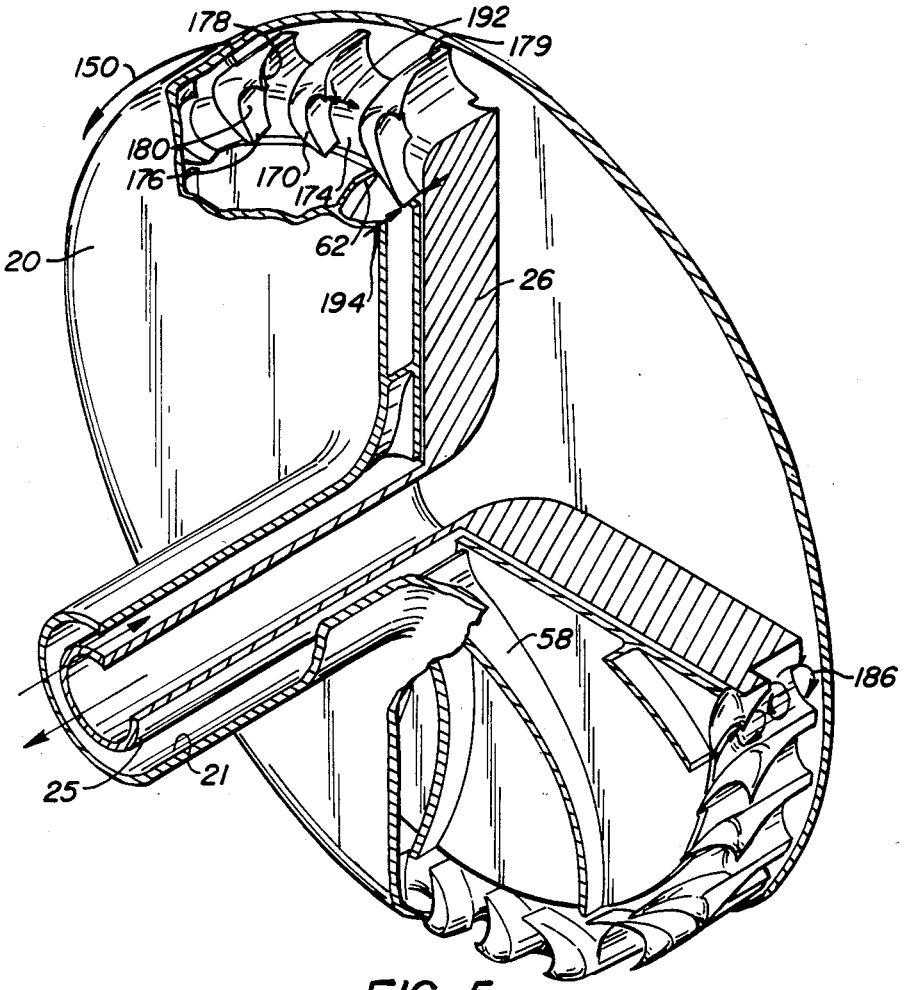
FIG. 5 is a perspective view of the anode-septum assembly illustrating centrifugal pump vanes mounted on the anode for increasing the liquid flow rate and liquid converging means and axial flow vanes mounted on the septum to induce swirl flow at the anode heat exchange surface.

Referring now to FIG. 5 as in the previously described first embodiment, liquid is directed through the conduit formed by the inside diameter of the anode rotating shaft 21 and the outside diameter of tube 25, to centrifugal pump vanes 58, which accelerate the liquid toward the anode heat exchange region.

As the coolant passes the periphery 62 of the centrifugal pump vanes 58, it enters a conduit 174 formed between successive converging members 170 mounted on stationary septum 26, together with associated flow vanes 179 (traverses the top of septum 26). Each conduit 174 communicates with an associated axial flow channel, formed between successor flow vanes, the anode heat exchange surface and the top of septum 26.

Each converging member 170 includes a first (entry) portion 176 disposed proximate to the periphery 62 of pump vanes 58, complex intermediate surface 180 and a discharge portion 178. The respective entry portions 176 extend outwardly from the side of septum 26 a distance (width) 194. Complex intermediate surface 180 provides a smooth transition curve from outwardly extending portion 176 to a tangential relationship with the associated flow vane 179 at discharge 178. Successive converging members provide an injection orifice (narrow portion) in conduit 174 of width 194 and length 192 (as will be explained), which cooperates with complex curved surface 180 to achieve the desired swirl flow geometry in the anode heat exchange region. The face of entry portion 176 is suitably disposed at an angle parallel to the velocity vector of the coolant as it leaves the centrifugal pump region. The liquid velocity vector is the resultant of the radial velocity component and the tangential velocity component imparted by the centrifugal pump vane. Alternatively, the converging member entry portion face 176 may make an angle with the coolant velocity vector. A preferred angle would be 7°. The opposite face of conduit 174 (i.e. the back surface of the successive converging member) may also be set to a 7° angle to the coolant velocity vector.

As the coolant traverses complex discharge 178 curved surface 180 of the converging members 170 its direction of travel is changed in a smooth and gradual manner to a path substantially opposite to the rotation 150 of the anode 20. In this manner, the relative velocity is effectively doubled thereby further increasing the heat exchange efficiency. For illustrative purposes, the swirl flow 186 in the anode heat exchange region is shown.

Figure 6:
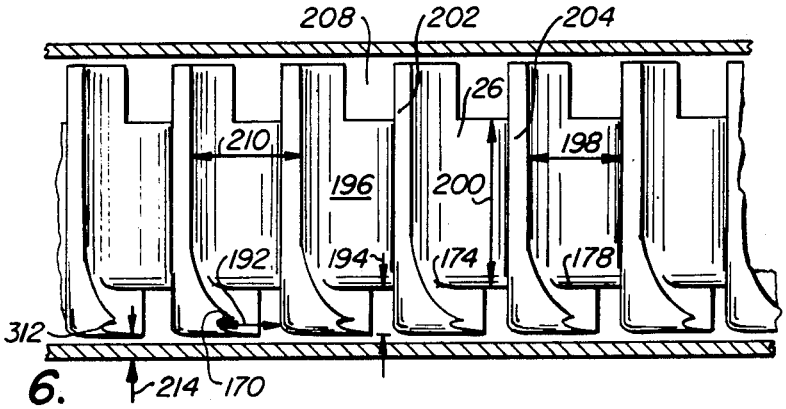
FIG. 6 is a partial vertical view of the septum and anode walls illustrating the liquid converging means and axial flow vanes mounted on the septum.

Referring now to FIG. 6, which is a top view of the septum containing the converging member 170 and corresponding conduit 174 of width 192 and length 194. The swirl flow conduit 196 which includes the anode heat exchange surface, whose width 198 and length 200 are bounded by axial flow vanes 202 and 204 on the sides and by the septum surface 26 on the bottom and anode heat exchange surface (not shown) on the top. It is in this region that the swirl flow of the coolant is obtained and it is also this region where swirl flow interaction with the anode heat exchange surface takes place. After traversing the anode heat exchange region the coolant exits through aperture 208. Swirl flow, being essentially circular in cross section, requires that the width 192 of the injection orifice of conduit 174 be approximately half the diameter 210 of the swirl flow conduit 196. To optimize the circular nature of the swirl flow, the injection orifice 178 should inject the liquid tangent to one of the surfaces of the swirl flow conduit i.e. the walls of the axial flow vanes, the anode heat exchange surface or the septum surface.

The angle $\theta$ at which the coolant is injected into swirl flow conduit 196 is approximately equal to $\tan \theta = l/d$ where l is the length 194 and d is the effective conduit diameter 210. The purpose of the injection angle $\theta$ is to ensure that the liquid flow does not interfere with itself as would be caused by a smaller angle and that there are no gaps between the adjacent leading and trailing edges of the flow, as would be caused by a greater angle of injection. The first condition, a smaller angle, would result in reduced heat transfer, whereas the second condition, a larger angle, would result in premature burn out.

The peripheral surfaces 312 of the converging member 170 are in close proximity at a distance 214 to the anode surface and thus act as bearing members to suppress vibration. Similarly, the shroud on the centrifugal pump, is also disposed in close proximity to the septum, to provide bearing support and suppresses vibration.

Figure 7:
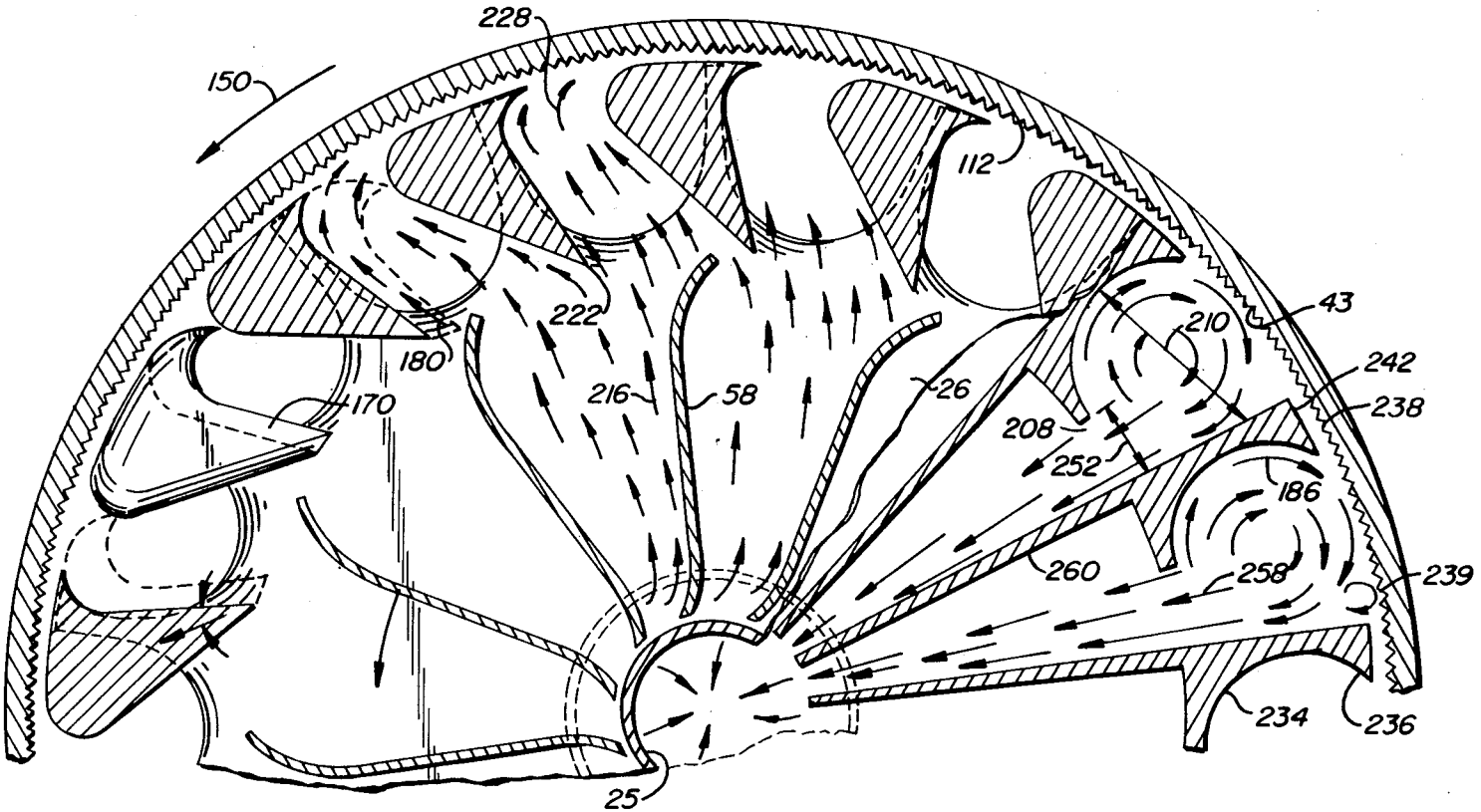
FIG. 7 is a partial cross-sectional view of the anode-septum assembly illustrating the centrifugal pump vanes mounted on the anode, the liquid converging members mounted on the septum, swirl flow interacting with the anode, and discharge of the liquid between radial axial flow vanes mounted on the discharge face of the septum.

Referring now to the lefthand side of FIG. 7, a sectional view of the anode-septum structure taken just on the input side of septum 26 is shown. As previously described, the coolant liquid (denoted 216) is accelerated up the face of the anode 20 by centrifugal pump vanes 58. The liquid (at point 222) enters converging members 170, and is redirected by converging member face 180 so as to enter the anode heat exchange region in swirl flow 228 in a direction opposite that of anode rotation (denoted by arrow) 150 at the anode heat exchange surface, thereby obtaining a very high shear velocity between the anode and liquid. The calculated surface roughness 112 on the anode heat exchange surface combined with the pressure gradient perpendicular to the anode surface generated by centrifugal force of the swirl flow combine to further increase the heat transfer and increase the critical heat flux.

Reference is now made to the righthand side of FIG. 7, wherein a section is taken at the outboard side of septum 26. To aid in maintaining optimum swirl flow characteristics, the radii 234 of the junctures of the axial flow vanes and septum surface are chosen to eliminate any dead spots or eddies. The peripheral portion of the axial flow vanes may also have a radius 236 provided to better conform to the circular nature of the swirl flow. An alternative is to set up a secondary swirl flow 238, 239 between the anode heat exchange surface 43, the periphery of the axial flow vane 242 and the main swirl flow 186. What makes this possible is the fact that the anode rotation 150 and the main swirl flow 186 are in opposite directions. Thus, the secondary swirl flow 238, 239 is driven in the same direction of rotation alternately by the anode rotation and then the swirl flow rotation. The secondary swirl flow, having been derived from the primary flow, will follow along with it through the swirl flow conduit. The relative axial velocity of the secondary swirl flow to the primary flow will vary depending upon relative energy losses i.e. friction, mixing, etc.

The peripheral surfaces 242 of the axial flow vanes are in close proximity to the anode heat exchange surface 43 and thus act as bearing members to suppress vibrations as previously discussed.

The swirl flow, having passed the anode heat exchange region exists through discharge aperture 208, the width 252 of the aperture 208 being about ½ of the diameter 210 of the swirl flow conduit. To obtain the most efficient flow pattern, the exhaust coolant should traverse the discharge face of the anode, not shown, such that it enters the exhaust tube 25 with a minimal circumferential component of velocity. This may be achieved by positioning the orifice 208 at the discharge end of the swirl flow conduit such that the velocity vector 258 of the swirl flow is pointing radially inward toward the exhaust tube 25. In general, the dimensions of the discharge orifice 208 are comparable to those of the injection orifice, 178 (FIG. 6). Stationary vanes 260 are mounted on the exhaust side face of the septum 26 and extend to close proximity to the anode wall to guide the coolant flow into the exhaust tube 25 and to inhibit the circular flow of coolant as induced by anode rotation. The close proximity of the vanes to the anode also serve as a bearing surface thereby further inhibiting vibration.

Figure 8:
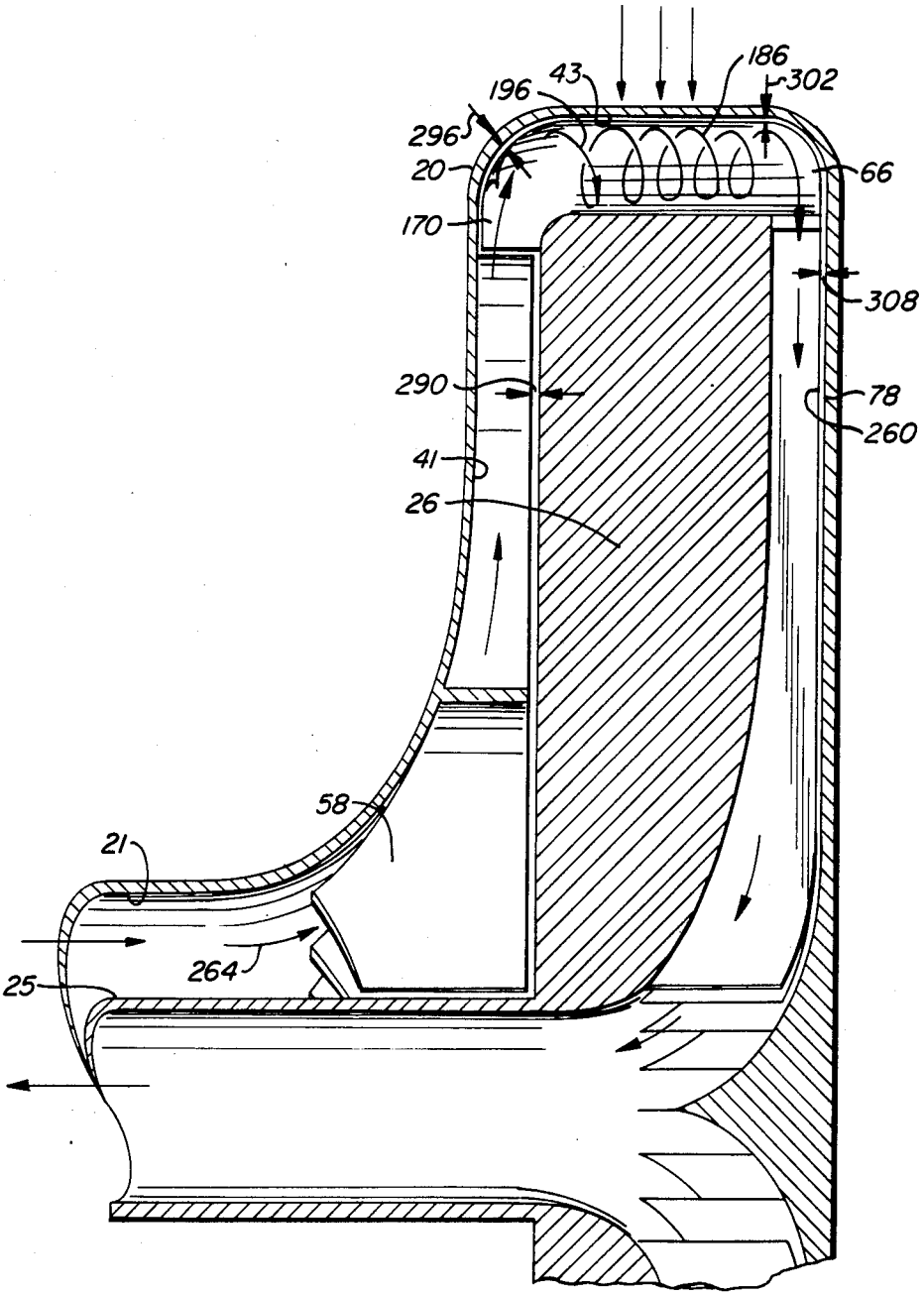
FIG. 8 is a partial side cross section of the anode septum assembly illustrating centrifugal pump vanes, liquid converging members, swirl flow of liquid, and discharge of liquid.

FIG. 8 illustrates a cross section view of the anode and internal components. The coolant 264 is shown entering the centrifugal impeller 58 from the conduit comprising the inside diameter of the hollow anode shaft 21 and the outside diameter of the discharge tube 25. Pumping means, in this case a centrifugal pump impeller 58, propelling the coolant up the face of the anode 41 toward flow converging means 170. During convergence of the liquid, the path of the liquid is also changed such that the direction and cross section of the liquid conforms to the predetermined conditions previously described. The conditions that should be met are that the coolant is injected into the swirl flow region 196 tangent to one of the surfaces defining the swirl flow region and is of such cross section that optimum swirl flow conditions are obtained. The swirl flow 186 passes through the anode heat exchange region 43 and exits down the anode discharge face 78 and into exhaust tube 25.

To minimize vibration and liquid leakage between segments, the gap 290 between the centrifugal impeller 58 and the septum 26 is small. In like manner, the gap 296 between the liquid converging 170 means and the anode 20 is also small. The gap 302 between the axial flow vanes 202, 204 and the anode 20 is also kept small. And, the gap 308 between the exhaust vanes 260 and the anode exhaust face is kept small. Close fitting of the rotating and stationary members in pumps and other other high speed liquid moving systems serves to dampen vibration in the system. The liquid trapped between the close tolerance surfaces acts as a bearing surface and vibration damping medium in being squeezed out and replaced by fresh liquid. As can be appreciated, close tolerances are desirable since the bearing effectiveness varies inversely as the cube of the spacing between the stationary and moving member.

A third preferred embodiment of the present invention includes the centrifugal pump impeller of the embodiment of FIGS. 2–4 as a means to increase the liquid flow rate, and incorporates a septum whose width is at least equal to the anode heat exchange surface and which is provided with a multitude of approximately radially directed conduits which, on the impeller side have their axis in line with the liquid flow and on the anode side have their axis directed somewhat toward the liquid discharge side of the anode, In this embodiment, the centrifugal impeller vanes are directly under the apertures in the stationary septum so that the accelerated liquid is directed into the conduits defined by the apertures whence it is directed at the anode heat exchange surface in the prescribed manner. The conduits are preferably curved so as to accept the liquid from the centrifugal pump impeller and redirect it to the anode heat exchange surface in the desired manner while not inducing undesirable flow patterns such as cavitation, eddies, or vortex shedding which can cause a reduction in power handling and vibration. The discharge side of the anode may have radially aligned vanes attached to the stationary septum such as in the manner of the embodiment of FIGS. 5–8. Such a third embodiment is shown in FIGS. 9, 10, and 11.

Figure 9:
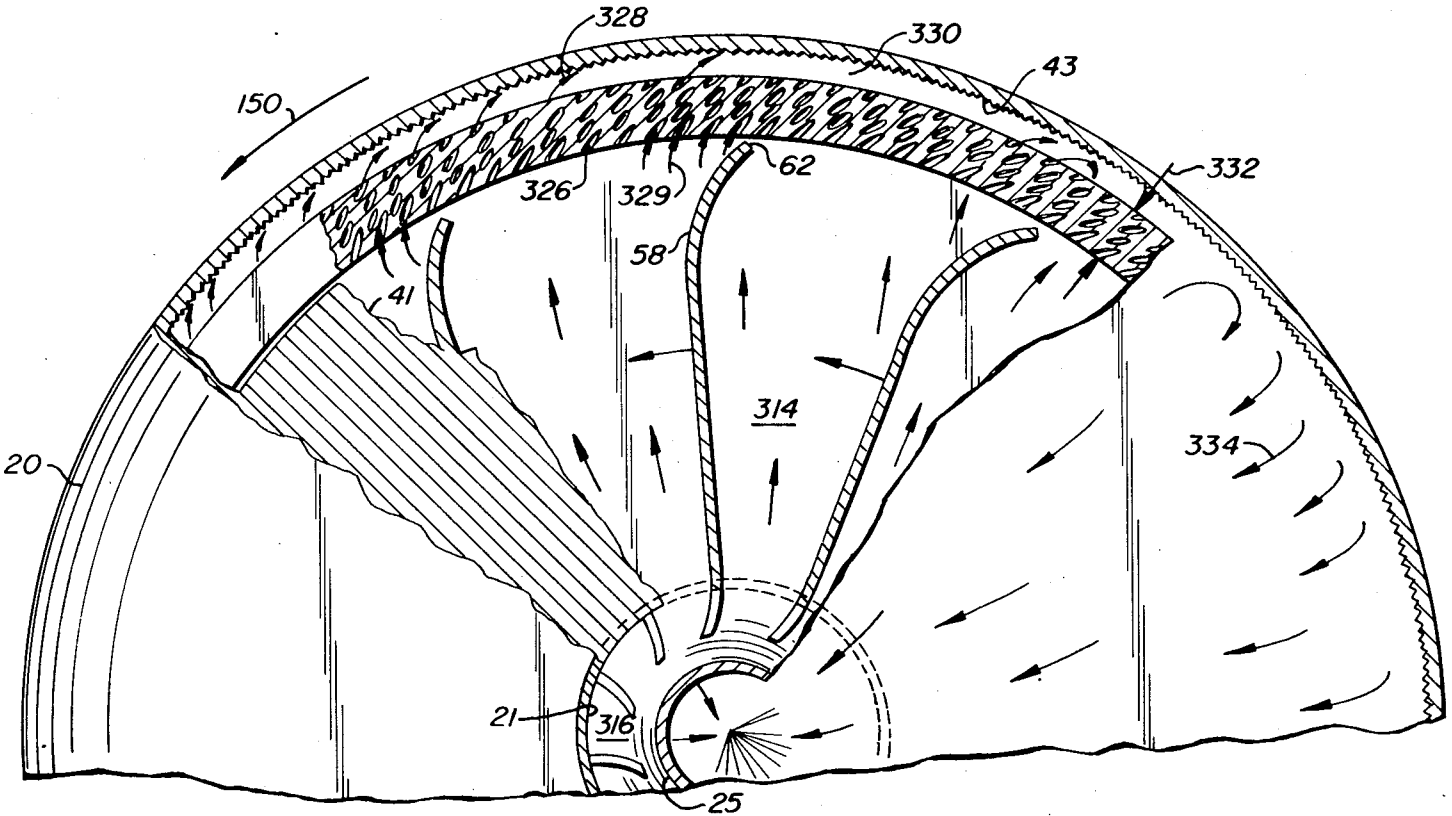
FIG. 9 is a partial cross-sectional view of the anode-septum assembly illustrating centrifugal pump vanes mounted on the input anode face, and radially oriented orifices in the septum to provide jets of liquid to impinge on the anode heat exchange surface.
Figures 10, 10A:
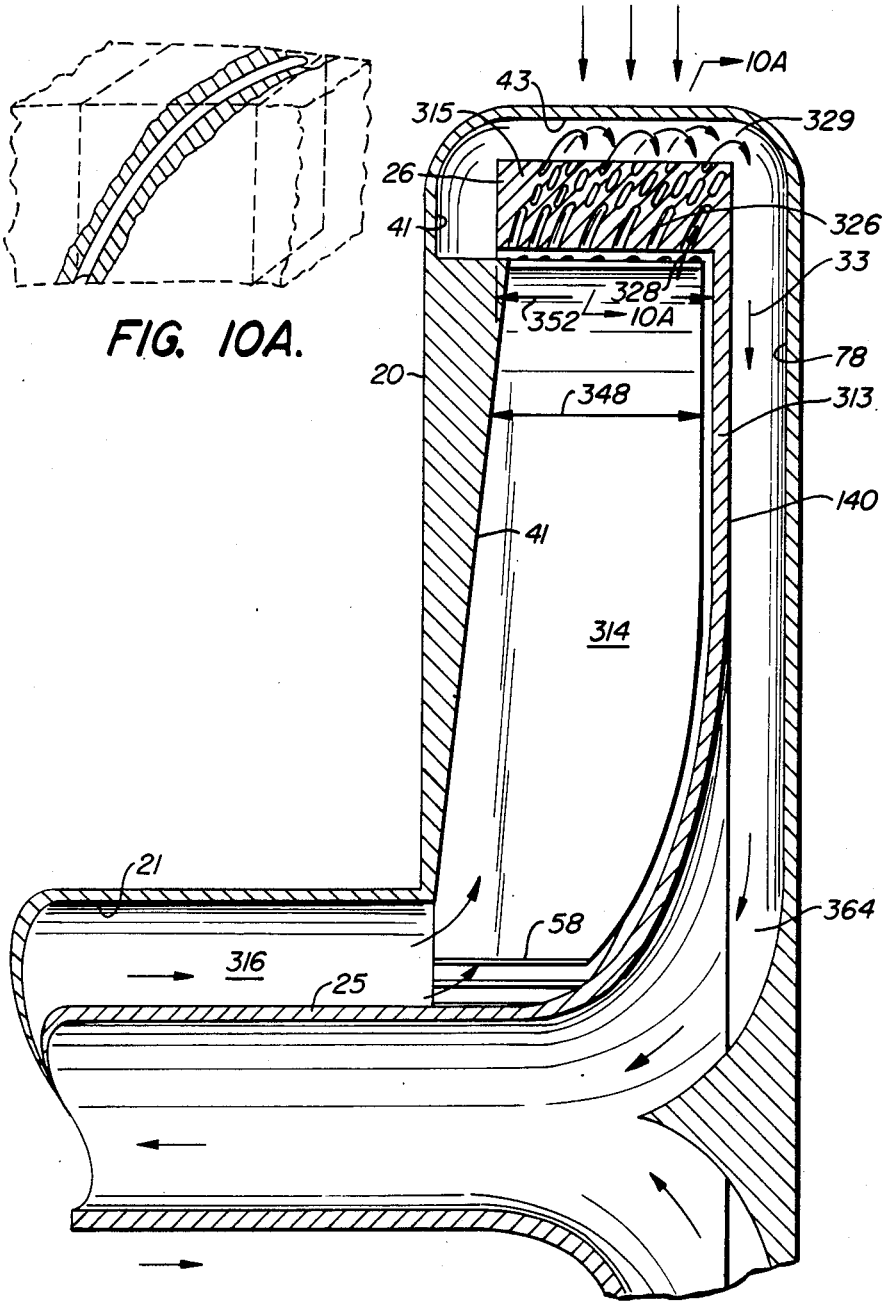
FIG. 10 is a partial side cross-sectional side view of the anode-septum assembly illustrating centrifugal pump vanes for increasing the liquid flow rate, radially disposed jets in the septum liquid jets interacting with the anode heat exchange surface, and radially disposed vanes on the discharge face of the septum.
Figure 11:
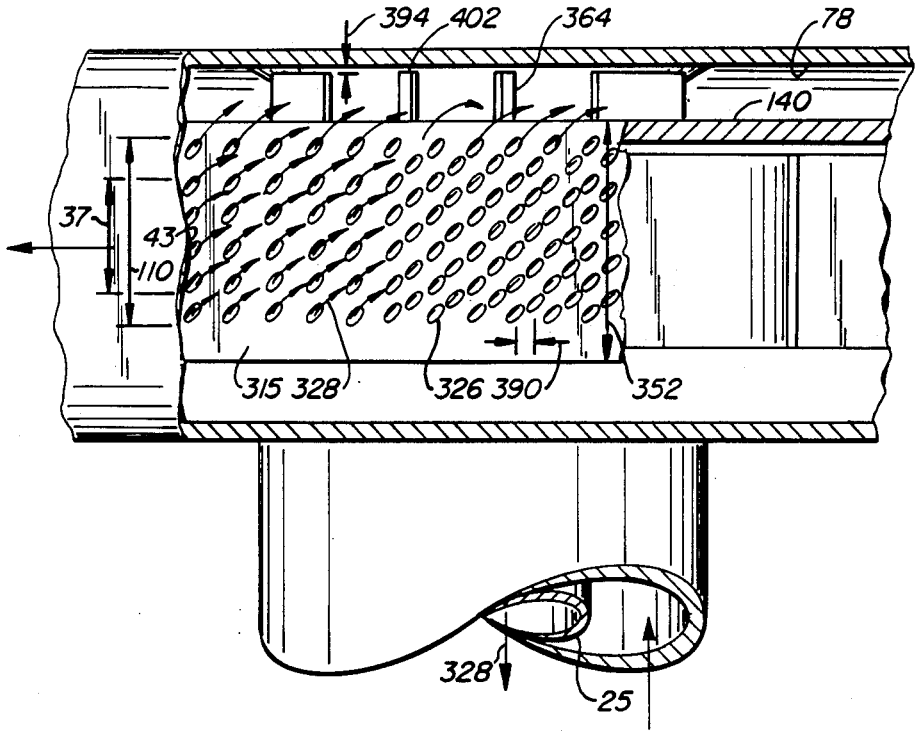
FIG. 11 is a partial vertical view of the anode-septum assembly illustrating the radially disposed jets in the septum.

Referring now to FIGS. 9, 10 and 11, centrifugal pump vanes 58 are mounted on the input face of the anode, and liquid jet conduits 326 are constructed into the thickness of septum, and radially disposed vanes on the discharge face of the septum.

Liquid enters the centrifugal pump region 314 from the conduit 316 consisting of the inside diameter of the hollow rotating shaft 21 upon which the anode is mounted and the outside diameter of the coolant exhaust tube 25. The liquid is accelerated by the centrifugal pump vanes 58 which are mounted integrally on the coolant wetted input face 41 of the anode 20. As previously noted, centrifugal pump vanes 58 may be shrouded to improve efficiency. The liquid flow 329, which may have energy imparted to it by the centrifugal pump vanes corresponding to pressure in excess of 200 psi, enters the conduits 326, which may be circular, after leaving the tip of the centrifugal pump vane 62. The conduit 326 may be shaped in a curved manner such that the liquid flow exits in a direction 328 opposite that of the direction 150 of anode rotation and angled toward the exhaust side of the anode. Thus, heat transfer is improved, and liquid flow through the anode is sufficiently maintained. The radial thickness 332 of the septum section containing the conduits 326 is such that the conduits, which are constructed approximately along a radius of the septum create minimal undesirable flow patterns such as cavitation, eddies or vortex shedding. The high velocity jets of liquid 328 from the multitude of conduit exits 330 strike the anode heat exchange surface 43. As noted, heat exchange surface 43 may include a calculated surface roughness to further enhance heat transfer. The coolant liquid develops a flow 334 exiting down the discharge flow of the anode after passing the anode heat exchange surface 43.

As is best seen in the cross-sectional side view of the anode-septum assembly of FIG. 10, stationary septum 26 includes a relatively thin plate 313, mounted on exhaust tube 25, and a peripheral cylindrical portion 315 disposed underlying anode heat exchange surface 43, extending inwardly from plate 313 towards anode wall 41. The width 352 of cylindrical septum portion 315 is greater than the width of heat exchange surface 43, and approximately central beneath heat exchange surface 43. Liquid enters the centrifugal pump region 314 from the conduit 316 consisting of the inside diameter of the hollow rotating shaft 21 and the outside diameter of the coolant exhaust tube 25. The liquid is accelerated toward the anode heat exchange region by the centrifugal pump vanes 58, which are mounted integrally on the coolant wetted input face 41 of anode 20. Vanes 58 extend to proximity with plate 313 (or the associated shroud is disposed proximate to plate 313) and underlie cylindrical septum portion 315. It is seen that the width 348 of the centrifugal pump vanes is of an extent approximately equal the width of cylindrical septum portion 315.

When the anode is rotating, high pressure generated by the centrifugal pump vanes 58, generally in excess of 200 psi for a 4-inch diameter anode rotating at 10,000 RPM, forces the liquid 328 through the conduits 326 at a high velocity. The entrance axis to conduits 326 may be parallel to the velocity vector of the liquid 328 to minimize undesirable flow characteristics due to discontinuities when entering the conduit 326. Conduits 326 are curved in such manner as to direct the exiting liquid jet 329 in a direction opposite that of the anode rotation, and angled towards the exhaust face of the anode. The high velocity liquid jets 329 strike the anode heat exchange surface 43 at a specified angle thereby providing a high shear velocity and a pressure gradient perpendicular to the anode heat exchange surface, combining to provide high heat transfer and breaking up inherently stable flow patterns. After passing the anode heat exchange surface 43, the liquid 33 discharges down the exhaust face 78 of the anode between radially disposed vanes 364 mounted on the exhaust face of the septum 140 and thence out stationary discharge tube 25. As is best seen in FIG. 11, a partial vertical view of the anode-septum assembly, the width 110 of the anode heat exchange surface 43 is generally from one to nine times greater than that of the width of the electron beam track 37. However, for small focal spots, i.e. small electron beam widths (and small corresponding lengths), generally focal spot sizes of less than 1 MM, the factor of nine may be greater depending on the anode wall thickness and thermal conductivity of the metal. The number of high velocity jets of liquid 328 is approximately determined by the septum width 352 times the septum circumference (not shown) divided by the center to center conduit spacing 390. The exits of the respective conduits 326 (and the jets 328) are disposed on cylindrical septum portion 315, in staggered rows such that essentially the entire heat exchange surface is sequentially inundated by the liquid coolant jets.

The liquid 328, having passed the anode heat exchange surface 43, discharges past the anode exhaust surface 78, being confined by radial vanes 364 to minimize rotational velocity induced by the anode exhaust surface 78. After traversing the anode exhaust face, the liquid 328 discharges through the concentric stationary exhaust tube 25 to an external heat exchanger prior to return to the tube. As previously discussed, the gap 394 between all close spaced rotating and stationary members, such as the periphery 402 of the vanes 364 mounted on the septum discharge surface 140 is maintained small so as to provide a bearing surface for the rotating anode and thereby minimize vibration.

A fourth preferred embodiment of the present invention provides for axial flow pump blades to be mounted on the inside diameter of the hollow rotating shaft and extending to close proximity to the inner stationary exhaust tube. One or more sets of axial flow pump blades may be mounted in series within the hollow rotating shaft so as to increase the liquid flow rate, and radially disposed vanes mounted on the input face of the septum and extending past the anode heat exchange surface and down the discharge face of the septum may be incorporated as the liquid directing means.

Figure 12:
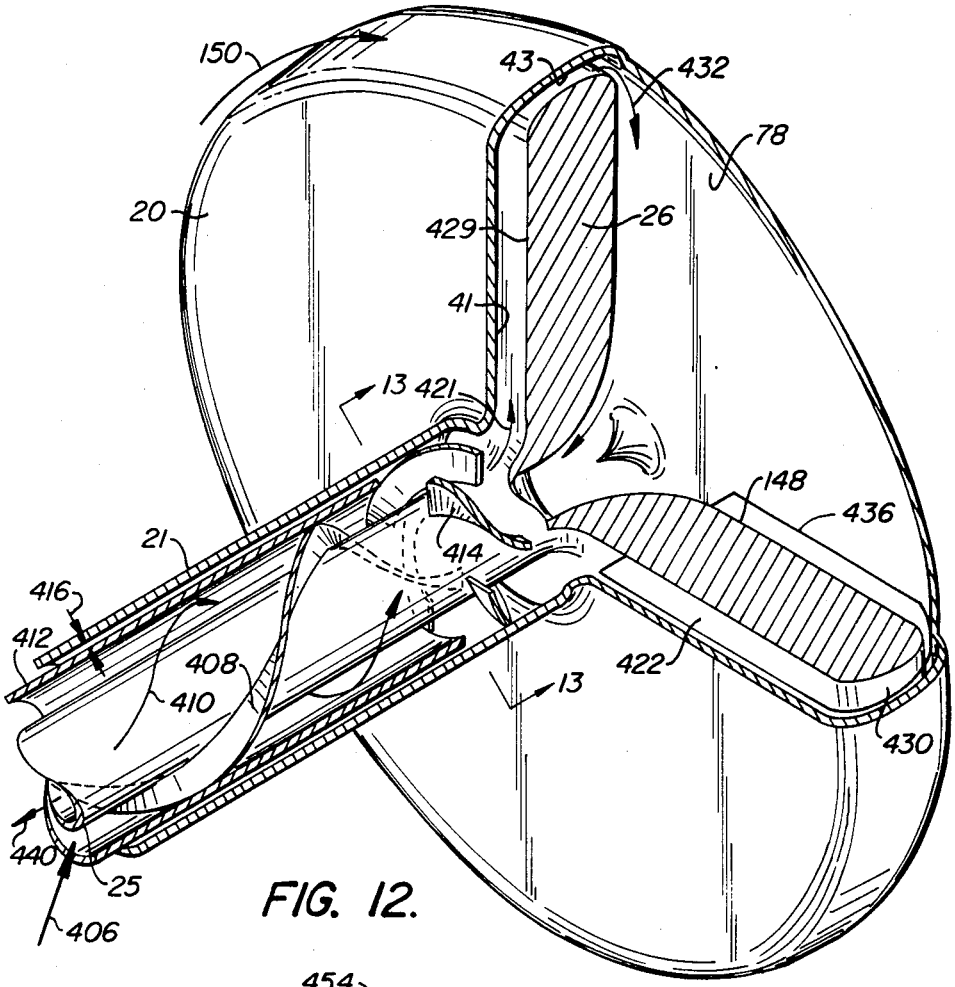
FIG. 12 is a perspective view of the anode-septum assembly illustrating axial flow pump blades mounted on the inside diameter of hollow rotating shaft for increasing the liquid flow rate.
Figure 13:
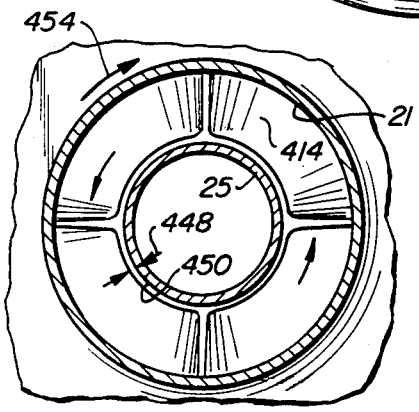
FIG. 13 is a cross section view illustrating the axial flow pump blades.

FIGS. 12 and 13 illustrate the fourth preferred exemplary embodiment of the present invention. FIG. 12 is perspective view of the anode-septum assembly. Liquid is injected 406 into the input liquid conduits at an angle that corresponds to the pitch angle of the helical vane 408 mounted on the outside diameter of the inner stationary exhaust tube 25. A second stationary tube 412, which generally has a thin wall thickness, may be mounted to the periphery of the helical vane 408. In general, the spacing 416 between the outside diameter of the second stationary tube 412 and the inside diameter of the hollow rotating shaft 21 is kept as small as possible. Thus, the bulk of the liquid is isolated from rotationally induced motion of the hollow rotating shaft 21.

Helical vane 408 produces in the liquid a rotation 410 that is opposite that of the rotation of the anode 150. The liquid, upon leaving the helical vane is almost immediately engaged by axial flow pump blades 414. An appropriate number of axial flow pump blades are mounted to the inside diameter of the hollow rotating shaft 21. Shown is a single set of blades, one stage. To further increase the liquid flow rate, a series of stages of axial flow pump blades may be mounted on the inside diameter of the hollow rotating shaft. The axial flow pump blades tend to also induce rotational motion in the liquid. However, because the liquid has rotational motion 410 induced by the helical vane 408 that is opposite that of the anode 20 the rotation induced by the axial flow pump blades 414 can be partially cancelled. The liquid 421 then travels up the input anode face 41 between approximately radial vanes 422 mounted around the circumference of the input face 429 of the stationary septum 26. To minimize rotational motion induced by the input anode face 41, a shroud (i.e. thin plate) (not shown) may be mounted on the periphery of the vanes and is positioned very close to the anode face 41, and extending the length of the vanes i.e. approximately the radius of the septum.

The liquid then passes the anode heat exchange surface 43. The shape of the vanes 430 in the vicinity of the anode heat exchange surface may be such as to optimize heat transfer by virtue of a high shear velocity as in the first preferred embodiment, or the vanes may have flow converging members to induce swirl flow as in the second preferred embodiment, or, the septum may have liquid jet conduits constructed into the peripheral thickness of the septum as described in the third preferred embodiment. Each embodiment having its benefits, as previously described. After passing the anode heat exchange surface 43, the liquid 432 exhausts down the discharge face 78 of the anode confined by approximately radial vanes 436 mounted on the discharge face 148 of the septum. Here too, a shroud may be mounted on the periphery of the vanes, as with the anode input face, with the shroud in close proximity of the anode discharge face 78 thus minimizing induced rotational motion. The liquid 440 then exhausts through inner stationary discharge tube 25. FIG. 13 is a cross section view of the axial flow pump blades. The blades 414 are mounted to the inside diameter of the hollow rotating shaft 21 which supplies the needed rotational motion 454. The spacing 448 between the outside diameter 450 of a stationary exhaust tube 25 is designed for optimum performance. Shown is one set of blades for a single stage pump. Sets of blades may be seriated on the inside diameter so as to obtain the desired flow rate.

Figure 14:
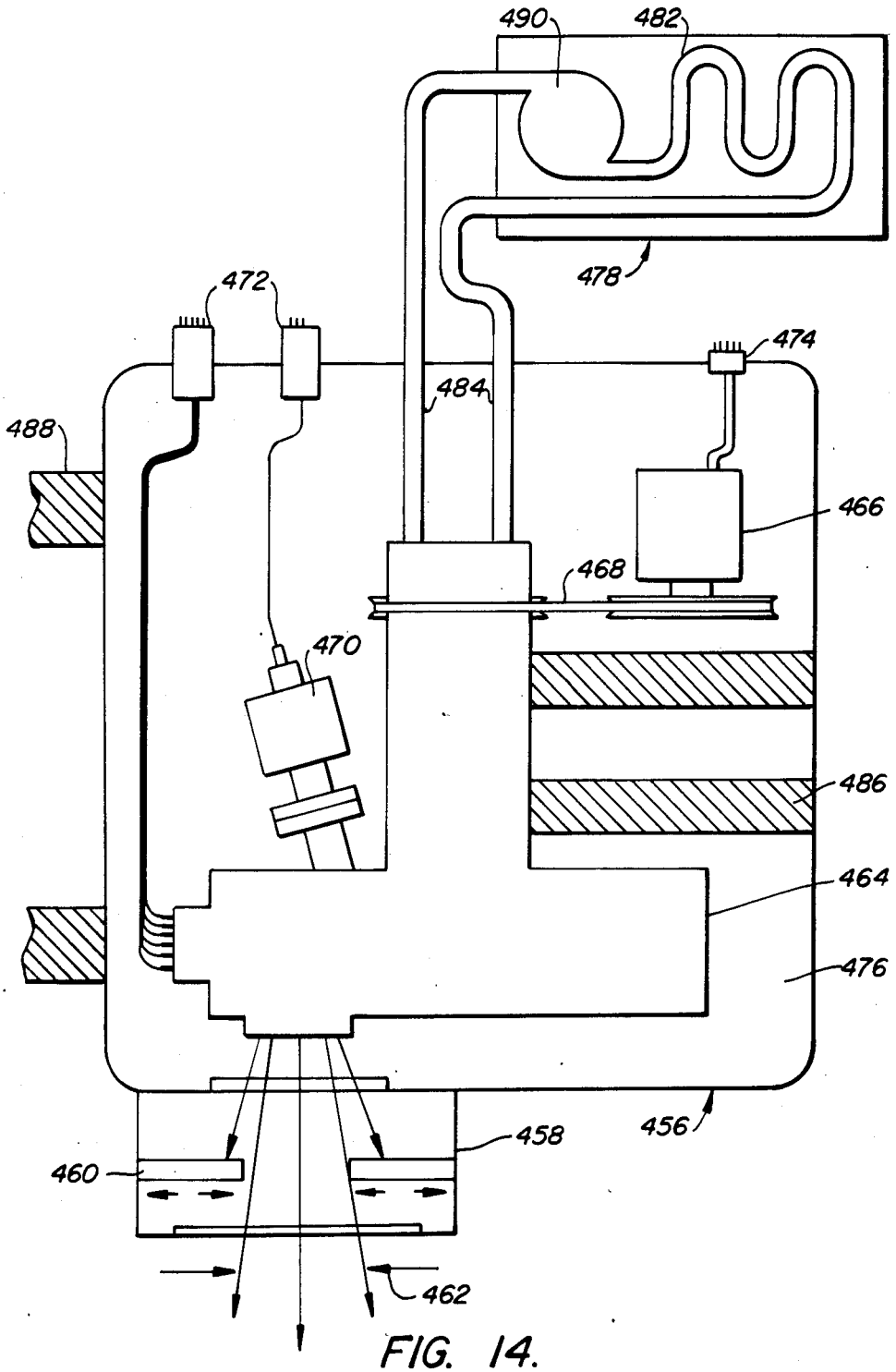
FIG. 14. PRIOR ART
FIG. 14 is an illustration of an x-ray tube assembly.

The liquid cooled rotating anode x-ray tube is mounted within an x-ray tube assembly. Such an x-ray tube assembly, shown in FIG. 14, typically comprises the following elements: an x-ray tube housing 456 which is generally made from an x-ray absorbing material; an x-ray beam limit device 458, commonly called a collimator; a liquid cooled rotating anode x-ray tube 464, as previously described; a motor 466 and a drive belt 468, or other means for rotating the anode at the desired rpm. Collimator 458 may contain movable shutters 460 to permit a variable x-ray field size 462 to be obtained. A vacuum pump 470 is mounted on or within the x-ray tube vacuum envelope to maintain the required vacuum. Vacuum pumping means that may be used include, for example, getters of Vac-Ion, titanium sublimation, cryogenic, diffusion or turbomolecular pumps. These pumps may be used alone or in combination. High 472 and low 474 voltage cables and connectors are utilized as required. A suitable high voltage isolation medium 476 is required within the x-ray tube housing 456 to prevent arc-over from high voltage surfaces on the x-ray tube to the grounded housing. A suitable medium 476 may be a gas such as a freon or sulphur hexafluoride or a liquid such as fluorocarbon, a silicone oil or a transformer oil. A vacuum may also be used as an insulating medium or selected regions may be potted with solid dielectrics such as epoxy or silicone. The above illustrative insulating means may be used alone or in combination. A heat exchanger 478 is required if the coolant system is to be of the closed loop type. Generally, the heat exchanger contains a pump 490 for circulating the coolant fluid and heat exchange means 482 to transfer the heat to a secondary medium.

The secondary medium is suitable air for air-cooled system and water for a water-cooled system. Suitable couplings and hoses 484 are utilized if the heat exchange is external to the x-ray tube assembly. Mounting elements 486 for the x-ray tube within the x-ray tube housing are also provided. These mounting elements are suitably formed of dielectric materials such as ceramic or plastic for high voltage isolation. External mounting means 488 are also provided for mounting the x-ray tube assembly in the desired systems configuration.

The rotating anode designs of the present invention will accommodate focal spot dimensions ranging from the very large with average powers in the hundreds of kilowatts that are used in x-ray crystallography to circular microfocal spots of a few kilowatts power or less that are used for high resolution imaging. In both instances, the high power densities present require high liquid coolant flow rates in order to achieve high cooling efficiencies. However, it is to be noted that the total power dissipation can vary over a range of about 100 to 1.

With power dissipations in the 100 KW range, the full liquid flow is probably required to keep the average temperature rise of the liquid coolant within reasonable bounds. However, with microfocus spot sizes and average power of a few kilowatts or less, the average temperature rise of the liquid coolant is negligible. In these circumstances, the liquid coolant flow rate is excessive from an average power dissipation viewpoint.

It would be desirable to maintain the needed high liquid flow rates in the anode heat exchange region to accommodate the high power densities present while at the same time varying the overall system liquid flow rate to accommodate the average power dissipation requirements of the anode thereby resulting in a predetermined average temperature rise of the coolant. This may be achieved by providing means within the anode whereby a predetermined percentage of the liquid coolant exiting down the discharge face of the anode is redirected such that it joins incoming liquid coolant at the input face of the anode to again pass over the anode heat exchange surface. The percentage of liquid exiting down the anode discharge face that is directed to merge with the incoming liquid on the anode input face is determined by the average power being delivered to the anode i.e. the specified average temperature rise of the liquid coolant.

Figure 15:
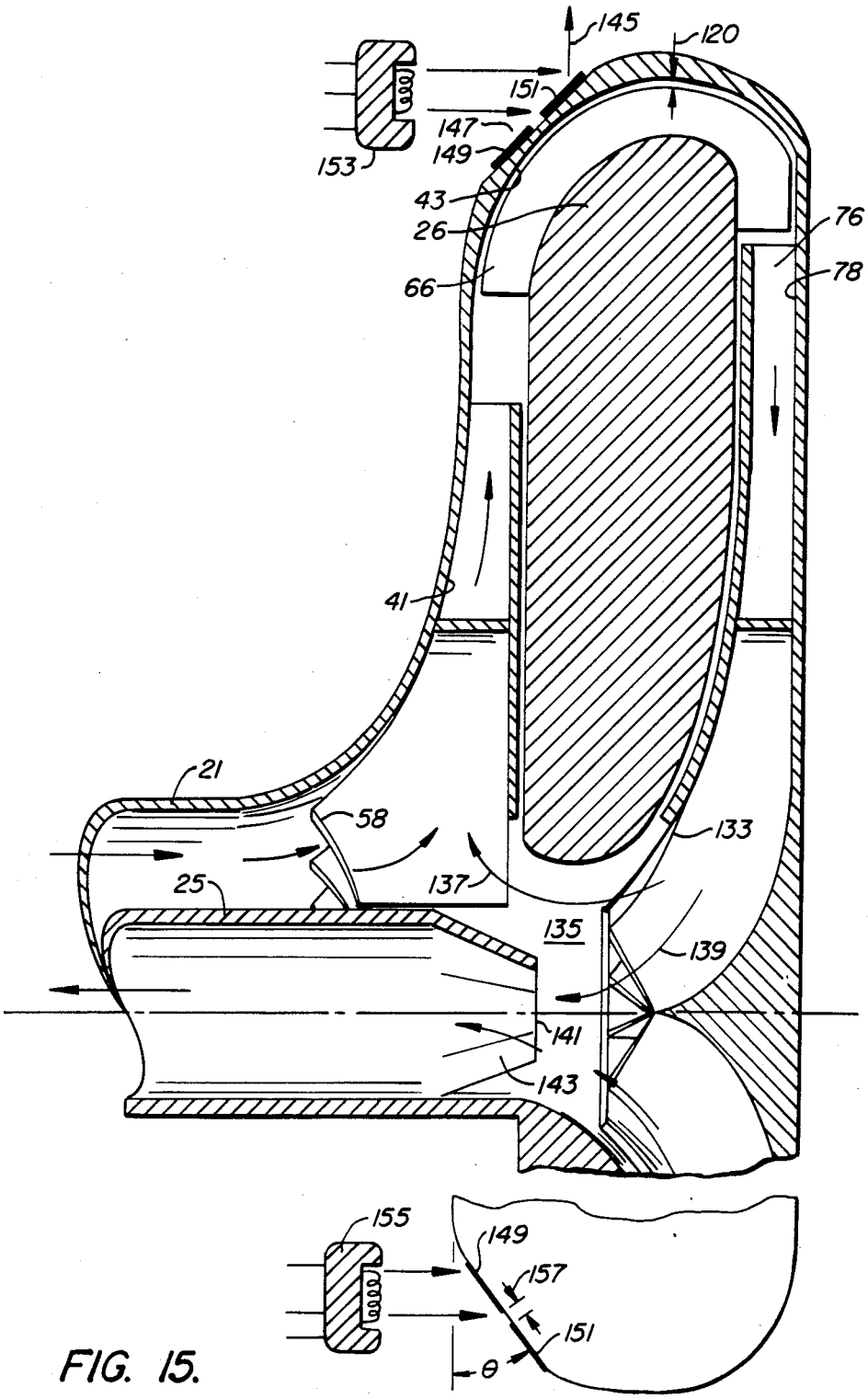
FIG. 15 is a partial cross section view of the anode-septum assembly illustrating multiple focal tracks on an angled focal track surface and associated electron guns, and means for diverting a portion of the heated exhaust liquid to mix with the incoming cold liquid coolant thereby causing a predetermined recirculation of the liquid coolant with the anode.

Referring to FIG. 15, on the flat anode focal track surface 147 are shown two separate electron focal tracks 151 and 149, each illuminated by separate electron guns, 153 and 155, respectively. Electron guns 153 and 155 are disposed radially with respect to the anode focal track surface and spaced at an angle apart, in this instance 180°. The generally close spacing 157 between focal tracks 149 and 151 is usually determined by heat transfer considerations i.e. maintaining optimum temperature gradients in order to minimize thermal stressing of the anode surface. The position of the focal spot on the anode focal track surface from each of the electron guns may be positioned arbitrarily on the anode, depending upon the result desired. For example, two micro-focus spots, focused on adjacent tracks, may be spaced apart on the anode the inter-ocular distance in order to achieve stereo or 3-D "vision". These focal spots may be illuminated continuously, or may be alternately turned on and off so as to synchronize with TV field rates or other periodic receiving means. Another application of multiple focal spots, also focused on separate focal tracks on the anode, is the use of three electron guns disposed about the anode such that they are spaced 120° or other suitable angle apart. In this manner, the three micro-focus spots may be used for precision location measurement and inspection by triangulation. in all cases, each anode focal track may be coated with different materials to provide different radiation characteristics. Also, each electron gun may be operated at different voltages with respect to the anode in order to obtain different radiation characteristic i.e. above and below an absorption edge of the material being x-rayed.

A further example of the use of multiple focal spots is in the manufacture of semiconductors (VLSI) by x-ray lithography. The output of previously described two focal spots on separate tracks spaced 180°, or other suitable angle, apart is viewed along the long dimension (length) from both directions and at such an angle from the anode surface so as to project two square focal spots. Thus, four x-ray focal spots are projected for lithography use. The system geometry is established such that one wafer alignment mechanism can serve two adjacent focal spots and associated wafer stages. One set of electronics can serve the two sets of wafer alignment mechanisms and four sets of wafer stages. Thus, high wafer throughputs and substantial economics in system construction can be achieved.

In conventional solid rotating anode x-ray tubes, the use of multiple focal spots of given geometry on multiple tracks results in a correspondingly shorter "on" time for the tube or other performance compromise due to anode heat storage, focal spot temperature or other limits. However, since the anode of the present invention is continuously cooled, there is no effect on the "on" time or power of the beam as with a conventional tube. Thus, the operating parameters i.e. focal spot power etc. of the tube are unaffected by the number of electron beams (and corresponding anode focal tracks) used. This is a fundamental performance advantage of the present invention.

Referring again to FIG. 15, incoming liquid coolant flows towards the anode in the conduit defined by the inside surface of hollow rotating shaft 21 and outside surface of stationary exhaust tube 25. The liquid is then engaged by centrifugal flow pump vanes 58 and propelled up anode input face 41. The liquid is then engaged by axial flow pump vanes 66 and redirected to traverse the path of anode rotation while interacting with the anode heat exchange surface 43 in the same manner as has been described for FIG. 2. The anode heat exchange surface 43 is shown as suitably curved, said being one of an infinite number of curves lying in the plane containing the axis of rotation of the anode, said plane being rotated about said axis of rotation. Thus, the liquid flowing over the curved anode heat exchange surface generates a pressure gradient having a component perpendicular to the anode heat exchange surface, thereby improving heat transfer and minimizing cavitation. As also shown, the peripheral surfaces of septum 26 and axial flow pump vanes 66 are correspondingly curved thereby minimizing undesirable flow characteristics and enabling the proper anode-axial flow pump vane spacing 120 to be maintained. The anode surface containing the electron beam focal track 147 is shown at an angle $\theta$ with the anode surface, and the axial flow pump vanes 66 and septum 26 have geometries designed in accordance with the principles of FIG. 2. The angle $\theta$ of the electron beam illuminated anode surface may be the same as for conventional solid anode rotating anode x-ray tubes, which enables an x-ray beam direction 145 which is normal to the axis of anode rotation, to be conveniently utilized. This has special merit when rectangular focal spots of long lengths to widths are utilized and which are projected at the shallow angle $\theta$ to obtain an apparent square focal spot.

Upon traversing the anode heat exchange surface 43, the now heated liquids is engaged by exhaust turbine vanes 76 and is exhausted down anode discharge face 78. Upon reaching the base region of the exhaust turbine vane 133, the liquid is caused to divide into two flow paths, one path is through conduit 135 whereby a predetermined percentage of the exhaust liquid, as shown by arrow 137, is caused to join the incoming liquid at the anode input face 41. The remainder of exhaust liquid, as shown by arrow 139, flows into stationary discharge tube 25 and then to an external heat exchanger where it is recycled. The percentage of liquid 139 that is exhausted is determined by the entrance cross section 141 of stationary exhaust tube 25. The slit leaved segments 143 of the exhaust tube 25 may be compressed or expanded to alter input cross section 141 thereby varying in corresponding fashion the percentage of liquid that is exhausted.

Figure 16:
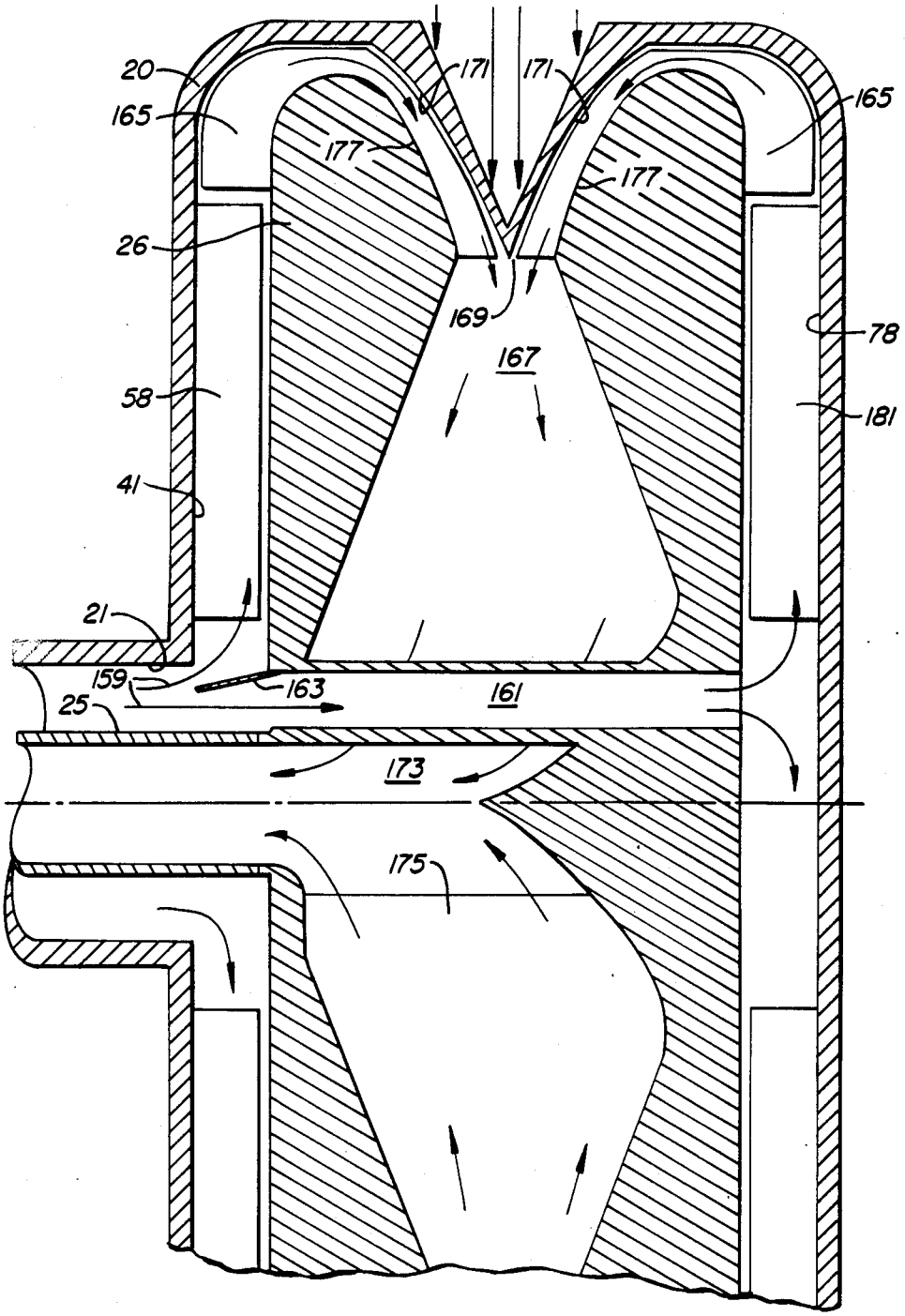
FIG. 16 is a partial cross section view of a septum and a rotating anode with a "V" groove illuminated by the electron beam, each side of the curved liquid cooled "V" groove having liquid flowing inward toward the center of the septum, said liquid being propelled by means attached to the anode.

In FIG. 13 of the previously cited copending application by Iversen, a "V" groove is provided in the electron beam illuminated surface of the rotating anode in order to provide a more uniform x-ray flux over most of the angle defined by the "V" groove. FIG. 16 illustrates a more efficient liquid cooling means for the "V" groove anode heat exchange surface. Liquid coolant enters the hollow anode structure 20 through the conduit defined by the ID of rotating hollow shaft 21 and the OD of stationary discharge tube 25. Input liquid coolant 159 is caused to divide equally between opposite anode faces 41 and 78 by use of multiple conduits, one being shown as 161. Multiple conduits, equally spaced and on the same radius as 161, traverse the septum 25 to enable the liquid coolant to reach centrifugal pump vanes 181 mounted on anode face 78. Scoops 163 may be provided to further optimize liquid flow into conduit 161. Centrifugal pump vanes 58 on anode face 41 and 181 on anode face 78 generate pressure precisely in the same manner as described for FIG. 2. Axial flow pump vanes 165 attached to both sides of stationary septum 26 redirect the liquid flow to be orthogonal to the path of anode rotation as in FIG. 2 except here the flow is curved inward toward the axis of rotation. The axial flow pump vanes 165 are shown terminating in the vicinity of the apex 169 of the "V" shaped anode heat exchange surface 171. However, these vanes may be extended approximately radially down 175 into the septum discharge region 173 to connect with stationary discharge tube 25 thereby minimizing any rotational component of velocity of the discharge liquid as well as serving as additional support members. Axial flow pump blades 414 as shown in FIGS. 12 and 13 may also be incorporated in FIG. 16 or may be used instead of the centrifugal pump vanes 58 and 181. Stationary septum 26 has the geometry of the fluid diverter surface 177, in the region of the anode heat exchange surface 171, dimensioned such that either a constant or variable liquid velocity over the anode heat exchange surface 171 is obtained as caused by a constant or variable liquid conduit cross section. The anode heat exchange surface 171 is shown as suitably curved, said curve being one of an infinite number of curves lying in the plane containing the axis of rotation of the anode, said plane being rotated about said axis of rotation. Thus, the liquid flowing over the curved anode heat exchange surface generates a pressure gradient having a component perpendicular to the anode heat exchange surface, thereby improving heat transfer and minimizing cavitation. As also shown, the peripheral surfaces of septum 26 and axial flow pump vanes 165 are correspondingly curved thereby minimizing undesirable flow characteristics and enabling the proper anode-axial flow pump vane spacing to be maintained. Upon passing the anode heat exchange surface 171, the liquid enters the interior 167 of stationary septum 26 whence it flows toward and into the stationary discharge tube 25 and from there to an external heat exchanger (not shown).

Figure 17:
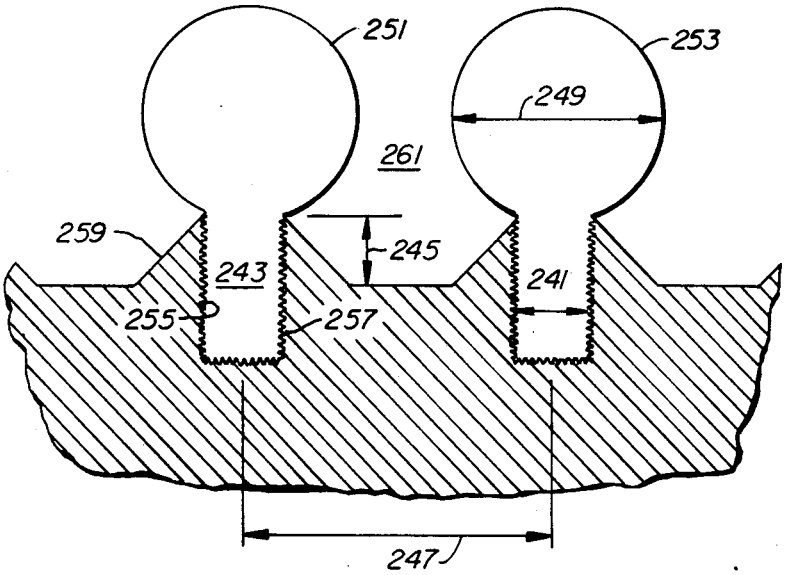
FIG. 17 is a partial cross section view of surface roughness elements disposed on the anode heat exchange surface in the form of approximate truncated cones containing cavities exposed to the liquid coolant.

A preferred embodiment of surface roughness elements 112 of FIG. 7 is shown enlarged in FIG. 17. The surface roughness 112 is in the approximate form of a truncated cone 259 which contain a cavity 243 which is exposed to the liquid coolant 261. The dimensions of cavities 243 of truncated cone 259 generally range from about 0.002 mm to 0.2 mm. The height of the roughness elements 245 ranges from 0.3 the height of the viscous sublayer to no more than twice the combined height of the viscous sublayer and the transition zone. For example, water at a velocity of 50 ft/sec. has a viscous sublayer thickness of about $5\times10^{-3}$ mm and a transition zone thickness of about $25\times10^{-3}$ mm. Spacing 247 between adjacent cavities is determined by maximum nucleate bubble diameter 249 such that at maximum heat flux, adjacent bubbles 251 and 253 do not merge to form the destructive film boiling condition. Spacing 247 generally ranges between 0.03 mm and 3 mm. Bubble size is determined by liquid and environment characteristics such as viscosity, surface tension, density, pressure, etc. Suitable methods for fabricating the cavities 243 include the use of laser drilling and mechanical drilling. The inside surface 255 of cavities 243 is further prepared with micro cavities 257, preferably reentrant, with dimensions generally in the range of $10^{-4}$ to $10^{-2}$ mm. Micro cavities 257 serve as permanent vapor traps that remain in equilibrium with the liquid under all conditions, including those of lowest temperature and highest pressure, and serve as the initial nucleate boiling sites until the larger cavities 243 commence nucleate boiling. Thus, full scale nucleate boiling becomes a two step affair, with initial nucleate boiling taking place at the trapped vapor sites 257, and then when sufficient vapor has been accumulated in the larger cavities 243, they take over. Micro cavities 257 act much like the starting motor in an automobile. Micro cavities 257 may be created by judicious selection of diamond, or other cutting material, particle size which is embedded in the drill bit. With the laser, reactive vapors or gases may be introduced which react with the anode material to create the desired pitting effect. Also, the outer surface of the truncated cone may also possess micro cavities due to the laser melting of material and subsequent deposition action at the edge of the cavity 243. A further preferred embodiment of the present invention incorporates the contoured surface concept described in International Publication No. WO 82/03522 published 14 Oct. 1982. The contoured surface of the above cited FIG. 7 is disposed on the anode heat exchange surface at an angle to the path of anode rotation in such a manner as to generate a component of velocity in the direction of liquid flow, said contoured surface acting basically in the manner of the axial flow pump blades of FIGS. 12 and 13 of the present invention. The contoured surface so placed thus tends to assist in propelling the liquid in the desired direction, that is, towards the anode discharge conduit. Said contoured surface also tends to inhibit any stable liquid flow patterns that might tend to be established in the anode heat exchange region and/or on the anode heat exchange surface. The contoured surface of the above cited FIG. 7 is shown as linearly traversing the anode heat exchange surface at the appropriate angle. To more smoothly engage the liquid, the contoured surface may be curved, for example, in the manner of the centrifugal pump vanes, as it traverses the anode heat exchange surface. Another means, alone or in combination with the above, to provide smooth engagement of the liquid by the contoured surface is to vary the height of the contoured surface above the anode heat exchange surface as it traverses said heat exchange surface. In general, said height will be less at each end of the contoured surface and greater in the middle. A preferred embodiment of said contoured surface are the flutes with rounded cusps of FIG. 4 of the above cited application by Iversen.

It should be appreciated that the foregoing describes a particularly advantageous liquid cooled rotating anode x-ray tube and the assembly which is suitable for use in applications that require the continuous duty generation of x-rays at high power levels. This includes high voltage x-rays for medical diagnostic use or low voltage x-rays for applications such as lithography.

It will be understood that the above description is of preferred exemplary embodiments of the present invention and that the invention is not limited to the specific forms shown. Modifications may be made in design and arrangements of the elements without departing from the spirit of the invention as expressed in the appended claims.

We claim:

1. In an apparatus of the type including a rotatable hollow anode adapted for irradiation by an energy beam, and including a heat exchange surface, said apparatus including a stationary septum disposed within said hollow anode for defining a fluid conduit within said anode, means for providing a flow of coolant liquid in said conduit to remove heat from said heat exchange surface by formation of nucleate vapor bubbles on and removal from said heat exchange surface, and means, coupled to said anode within said fluid conduit for, responsive to rotation of said anode, increasing the rate of flow of said coolant liquid relative to said heat exchange surface; improvement wherein said apparatus further includes:

means, including curved surfaces disposed on said stationery septum to receive coolant liquid from said means for increasing rate of flow, for directing the flow of said liquid to traverse the path of anode rotation.

2. The apparatus of claim 1, wherein said means to increase the liquid flow rate comprises centrifugal pump vanes mounted integrally on the input interior face of said hollow anode.

3. In the apparatus of claim 1, the further improvement wherein said means for directing liquid flow constitutes a plurality of axial flow pump vanes mounted on said stationary septum in predetermined disposition with said anode heat exchange surface, such that the liquid flow traverses the path of anode rotation in shear flow.

4. In the apparatus of claim 3, the further improvement wherein said means for directing the liquid flow further includes respective flow converging means, associated with each of said axial flow pump vanes, for inducing a swirl flow of the liquid as it traverses the anode heat exchange surface n the conduits defined by adjacent axial flow pump vanes.

5. In the apparatus of claim 1 wherein said means for directing the liquid flow comprises a plurality of approximately radially directed conduit means disposed around the circumference of a peripheral portion of said stationary septum, and directed at the anode heat exchange surface, for forming jets of coolant liquid emanating from said radial conduits to strike said heat exchange surface.

6. The apparatus of claim 2, wherein said coolent liquid has associated therewith an operating Reynolds number and the anode heat exchange surface is provided with a calculated surface roughness such that at the operating Reynolds number, the roughness height is no less than 0.3 times the thickness of a viscous sublayer in said coolent liquid nor greater than the combined thickness of the viscous sublayer and a transition zone of said coolent liquid.

7. In the apparatus of claim 6, the further improvement wherein said surface roughness comprises elements approximately in the shape of truncated cones having bases affixed to the anode, said cones containing approximately centered cavities which are exposed to the liquid, said cone height being no less than 0.3 times the height of the viscous sublayer nor more than twice the combined height of the viscous sublayer and transition zone.

8. In the apparatus of claim 7, the further improvement wherein said cavities have dimensions in the range of 0.002 mm to 0.2 mm, and said cones are spaced apart at distances ranging from 0.03 mm to 3 mm.

9. In the apparatus of claim 8, the further improvement wherein said cavity walls include micro cavities.

10. In the apparatus of claim 9, the further improvement wherein dimensions of said micro cavities are in the range of $1\times10^{-4}$ mm to $1\times10^{-2}$ mm.

11. In the apparatus of claim 2 wherein said rotatable anode includes an exhaust face, disposed downstream in said coolant flow from said heat exchange surface, the further improvement wherein said apparatus comprises exhaust turbine vane means, affixed to the rotatable anode exhaust face, for reducing radially induced velocity in the liquid being discharged from the back exchange surface.

12. In the apparatus of claim 2, the further improvement wherein said apparatus further comprises:

means, disposed within said hollow anode, for redirecting a predetermined percentage of heated liquid coolant which has passed over the anode heat exchange surface to join the incoming cold liquid coolant, and effect a partial recirculation of liquid coolant within said anode.

13. In the apparatus of claim 12, wherein said apparatus includes an incoming coolant conduit and said septum includes a stationary discharge tube for receiving coolant liquid that has passed said heat exchange surface, the further improvement wherein said means for redirecting comprises conduits, adjacent the stationary discharge tube for redirecting a predetermined percentage of the liquid flow from the liquid coolant discharge conduit to flow into the incoming coolant conduit.

14. In the apparatus of claim 13, the further improvement wherein said apparatus includes means for varying the entrance cross section of the stationary discharge conduits thereby altering the percentage of liquid coolant flow that is discharged.

15. The apparatus of claim 2, further including means for holding all rotating and stationary members that are in close proximity to each other in such close spacing as to provide a bearing surface effect.

16. In an x-ray generating apparatus of the type including a rotatable hollow anode adapted for irradiation by an energy beam, and including a heat exchange surface, said apparatus including means for providing flow of coolant liquid to remove heat from said heat exchange surface by formation of nucleate vapor bubbles on said heat exchange surface, the improvement wherein:

said heat exchange surface comprises curves in planes passing through the axis of rotation of said anode, disposed to generate, responsive to relative velocity between said coolant and said heat exchange surface, a pressure gradient in said coolant liquid having a magnitude proportional to the square of said relative velocity and having a component perpendicular to said heat exchange surface.

17. The apparatus of claim 16 wherein said curves are concave with respect to said flow of coolant liquid.

18. The apparatus of claim 16, further comprising:

an envelope;

means for rotatably mounting said hollow anode within said envelope;

a stationary septum disposed within said hollow anode for defining a fluid conduit for directing said coolant liquid to said heat exchange surface;

an energy beam source, mounted within said envelope and electrically isolated from said anode, for generating an energy beam disposed to irradiate a portion of the outer surface of said anode in predetermined disposition with said heat exchange surface;

said septum including a surface in predetermined relative disposition with said heat exchange surface defined by convex curves in said planes passing through the axis of rotation of said anode.

19. In the apparatus of claim 18, the improvement wherein said apparatus further comprises centrifugal flow pump vane means, disposed on a face of said rotatable anode in contact with said coolant liquid, for causing said coolant to flow radially outward towards said heat exchange surface.

20. In the apparatus of claim 18, the improvement wherein said heat exchange surface includes cavities having diameters ranging from 0.002 mm to 0.2 mm and spaced apart on said heat exchange surface at distances from 0.03 mm to 3 mm.

21. In the apparatus of claim 18, the further improvement wherein said apparatus includes respective independent electron guns, and multiple adjacent focal tracks on the anode surface, each illuminated by one of said electron guns, said electron guns being disposed about the anode separated by predetermined distances in the proximity of said focal tracks.

22. The apparatus of claim 18, wherein said coolent liquid has associated therewith an operating Reynolds number and the anode heat exchange surface is provided with a calculated surface roughness such that at the operating Reynolds number, the roughness height is no less than 0.3 times the thickness of a viscous sublayer in the coolent liquid nor greater than the combined thickness of the viscous sublayer and a transition zone in said coolent liquid.

23. In the apparatus of claim 18, wherein said rotatable anode includes an exhaust face, disposed downstream in said coolant flow from said heat exchange surface, the further improvement wherein said apparatus comprises exhaust turbine vane means, affixed to the rotatable anode exhaust face, for reducing radially induced velocity in the liquid being discharged toward the center of the anode.

24. In the apparatus of claim 18, the further improvement wherein said apparatus further comprises:

means disposed within said hollow anode, for redirecting a predetermined percentage of heated liquid coolant which has passed over the anode heat exchange surface to join the incoming cold liquid coolant, and effect a partial recirculation of liquid coolant within said anode.

25. In the apparatus of claim 24, wherein said apparatus includes an incoming coolant conduit, and said septum includes a stationary discharge tube for receiving coolant liquid that has passed said heat exchange surface, the further improvement wherein said means for redirecting comprises conduits, adjacent said stationary discharge tube for redirecting a predetermined percentage of the liquid flow from the liquid coolant discharge conduit into the incoming coolant conduit.

26. In the apparatus of claim 25, the further improvement wherein said apparatus includes means for varying the entrance cross section of the stationary discharge conduits to alter the percentage of liquid coolant flow that is discharged.

27. In the apparatus of claim 17, the improvement wherein said heat exchange surface includes cavities having dimensions ranging from 0.002 mm to 0.2 mm and spaced apart on said heat exchange surface at distances from 0.03 mm to 3 mm.

28. In the apparatus of claim 27, the further improvement wherein said cavity walls include micro cavities, the diameter of said micro cavities being in the range of $1\times10^{-4}$ mm to $1\times10^{-2}$ mm.

29. In the apparatus of claim 28, the further improvement wherein said cavity walls include micro cavities, the diameter of said micro cavities being in the range of $1\times10^{-4}$ mm to $1\times10^{-2}$ mm.

30. The apparatus of claim 16, wherein said coolent liquid has associated therewith an operating Reynolds number and the anode heat exchange surface is provided with a calculated surface roughness such that at the operating Reynolds number, the roughness height is no less than 0.3 times the thickness of a viscous sublayer in the coolent liquid nor greater than the combined thickness of the viscous sublayer and a transition zone in said coolent liquid.

31. In the apparatus of claim 30, the further improvement wherein said surface roughness comprises elements approximately in the shape of truncated cones having bases affixed to the anode, said cones containing approximately centered cavities which are exposed to the liquid, said cone height being no less than 0.3 times the height of the viscous sublayer nor more than twice the combined height of the viscous sublayer and transition zone.

32. In the apparatus of claim 31, the further improvement wherein said cavities have dimensions in the range of 0.002 mm to 0.2 mm, and said cones being spaced apart at distances ranging from 0.03 mm to 3 mm.

33. In the apparatus of claim 32, the further improvement wherein said cavity walls include micro cavities.

34. In the apparatus of claim 33, the further improvement wherein the dimensions of said micro cavities are in the range of $1\times10^{-4}$ mm to $1\times10^{-2}$ mm.

35. In the apparatus of claim 16, wherein said rotatable anode includes an exhaust face, disposed downstream in said coolant flow from said heat exchange surface, the further improvement wherein said apparatus comprises exhaust turbine vane means affixed to the rotatable anode exhaust face, for reducing radially induced velocity in the liquid being discharged from the heat exchange surface.

36. The apparatus of claim 16, further including means for holding all rotating and stationary members that are in close proximity to each other in such close spacing as to provide a bearing surface effect.

37. In the apparatus of claim 16, the further improvement wherein said apparatus further comprises:

means, disposed within said hollow anode, for redirecting a predetermined percentage of heated liquid coolant which has passed over the anode heat exchange surface to join the incoming cold liquid coolant, and effect a partial recirculation of liquid coolant within said anode.

38. In the apparatus of claim 16, the further improvement wherein said apparatus includes respective independent electron guns, and multiple adjacent focal tracks on the anode surface, each illuminated by one of said independent electron guns, said electron guns being disposed about the anode in the proximity of said focal tracks, said electron guns being separated by predetermined distances.

39. In the apparatus of claim 16, the improvement wherein said apparatus further comprises centrifugal flow pump vane means, disposed on a face of said rotatable anode in contact with said coolant liquid, for causing said coolant to flow radially outward towards said heat exchange surface.

40. In the apparatus of claim 16, the improvement wherein said heat exchange surface includes cavities having dimensions ranging from 0.002 mm to 0.2 mm, and spaced apart on said heat exchange surface at distances from 0.03 mm to 3 mm.

41. In the apparatus of claim 16, the further improvement wherein said heat exchange surface comprises curves in planes orthogonal to the axis of rotation of said anode.

42. In an apparatus of the type including a rotatable hollow anode, the exterior circumferential surface of said anode including a generally v-shaped grove adapted for irradiation by an energy beam, the interior surface of said hollow anode corresponding to said v-shaped groove comprising a heat exchange surface having respective sides, said apparatus further including a stationary septum disposed within said anode, said septum, in cooperation with interior surfaces of said anode, forming a conduit for directing coolant liquid to said heat exchange surface to remove heat from said heat exchange surface by formation of nucleate vapor bubbles thereon, and means for providing a flow of coolant liquid through said conduit, the improvement wherein:

said heat exchange surface comprises curves, concave with respect to said coolant liquid flow, in planes passing through the axis of rotation of said anode, disposed to generate, responsive to relative velocity between said coolant liquid and said heat exchange surface, a pressure gradient in said coolant liquid having a magnitude proportional to the square of said relative velocity with a component perpendicular to said heat exchange surface; and said septum includes respective surfaces generally corresponding to said heat exchange surface, comprises curves, convex with respect to said liquid coolant flow, in said planes passing through the axis of rotation of said anode.

43. In the apparatus of claim 42, the further improvement wherein said x-ray tube further includes means for dividing incoming liquid coolant flow into two approximately equal flows upstream of the respective sides of said heat exchange surface and for directing said flows against corresponding sides of said heat exchange surface; and a means, including common discharge tube disposed radially inward of said heat exchange surface, for receiving and exhausting said liquid coolant flows after said coolant has passed over said heat exchange surface sides.

44. In the apparatus of claim 42, the further improvement wherein said apparatus further includes means for dividing the incoming liquid coolant flow approximately equally between two opposing liquid flows and directing the respective flows radially outward to remove heat from the respective sides of said heat exchange surface; and axial flow pump vane means affixed to the stationary septum in the proximity of the periphery of the anode of engage said liquid, for causing said liquid to traverse the path of anode rotation while passing over the anode heat exchange surface; and discharge means, disposed in the interior of said septum, for receiving and discharging said opposing flow of coolant.

45. In the apparatus of claim 42, the further improvement wherein:

each side of said heat exchange surface comprises concave curves in planes passing through said anode heat exchange surface and the axis of anode rotation, disposed to establish a pressure gradient in response to flow of said liquid over said curved heat exchange surface, said pressure gradient having a component perpendicular to said heat exchange surface and being proportional to the square of the relative velocity between said curve and said liquid coolant flow; and the surfaces of said septum adjacent said concave curved heat exchange surface comprise convex curves in said planes.

46. In the apparatus of claim 45, the improvement wherein said apparatus further comprises centrifugal flow pump vane means, disposed on a face of said rotating anode in contact with said coolant liquid, for causing said coolant to flow radially outward towards said heat exchange surface.

47. In the apparatus of claim 42, the further improvement wherein said apparatus further comprises centrifugal flow pump vane means, disposed on faces of said rotating anode opposing said heat exchange surface, for causing said liquid to flow radially outward.

48. In the apparatus of claim 42, the improvement wherein said heat exchange surface includes cavities having diameters ranging from 0.002 mm to 0.2 mm and spaced apart on said heat exchange surface at distances from 0.03 mm to 3 mm.

49. In the apparatus of claim 48, the further improvement wherein said cavity walls include micro cavities, the diameter of said micro cavities being in the range of $1\times10^{-4}$ mm to $1\times10^{-2}$ mm.

50. In the apparatus of claim 42, the further improvement wherein said apparatus includes respective independent electron guns, and multiple adjacent focal tracks on the anode surface, each illuminated by one of said electron guns, said electron guns being disposed about the anode separated by predetermined distances in the proximity of said focal tracks.

* * * * *